US012746481B2

(12) United States Patent
Dobrogorsky et al.

(10) Patent No.: US 12,746,481 B2
(45) Date of Patent: Sep. 29, 2026

(54) MOTION CONTROLLED SPINNING TOP

(71) Applicant: Orbt Pty Ltd., Red Hill (AU)

(72) Inventors: Daniel Dobrogorsky, Melbourne (AU); Josh Swinnerton, Red Hill (AU)

(73) Assignee: ORBT Pty Ltd, Red Hill (AU)

( * ) Notice: Subject to any disclaimer, the term of this patent is extended or adjusted under 35 U.S.C. 154(b) by 198 days.

(21) Appl. No.: 18/808,312

(22) Filed: Aug. 19, 2024

(65) Prior Publication Data

US 2026/0048333 A1 Feb. 19, 2026

(51) Int. Cl.
*A63H 1/00* (2019.01)
*A63H 30/04* (2006.01)

(52) U.S. Cl.
CPC ..... *A63H 1/00* (2013.01); *A63H 30/04* (2013.01); *A63H 2200/00* (2013.01)

(58) Field of Classification Search
CPC ..... A63H 1/20; A63H 2200/00; A63H 30/04; A63H 1/00
USPC ..... 446/233
See application file for complete search history.

(56) References Cited

U.S. PATENT DOCUMENTS

| | | | | |
|---|---|---|---|---|
| 1,732,085 | A | 10/1929 | Fixen | |
| 3,082,574 | A | 3/1963 | Hellman | |
| 3,224,142 | A | 12/1965 | Pawelka | |
| 3,628,285 | A | 12/1971 | Murakami | |
| 4,453,342 | A | 6/1984 | Sahar | |
| 5,823,845 | A * | 10/1998 | O'Berrigan | A63H 11/14 446/234 |
| 6,458,008 | B1 | 10/2002 | Hyneman | |
| 6,685,531 | B1 | 2/2004 | Tiefel | |
| 6,739,939 | B2 | 5/2004 | Matsukawa | |
| 6,773,328 | B2 | 8/2004 | Tiefel | |
| 6,913,506 | B2 | 7/2005 | Tiefel | |
| 7,018,263 | B2 | 3/2006 | Tiefel | |
| 7,063,589 | B2 | 6/2006 | Matsukawa | |
| 8,066,543 | B2 | 11/2011 | Kitamura | |
| 8,833,189 | B2 | 9/2014 | Fahnline | |
| 9,395,725 | B2 | 7/2016 | Bernstein | |
| 9,526,999 | B2 | 12/2016 | Lin | |
| 9,669,322 | B2 | 6/2017 | Nagai | |
| 9,914,061 | B2 | 3/2018 | Cai | |
| 10,168,701 | B2 | 1/2019 | Berberian | |
| 10,596,477 | B1 * | 3/2020 | Whipple, Jr. | A63H 17/00 |
| 11,198,057 | B2 | 12/2021 | Bubnjic | |

(Continued)

FOREIGN PATENT DOCUMENTS

| | | |
|---|---|---|
| CN | 203494153 | 3/2014 |
| KR | 20220072945 | 6/2022 |
| WO | 2021066217 A1 | 4/2021 |

OTHER PUBLICATIONS

International Search Report and Written Opinion for PCT/AU2025/050888, mailed Oct. 31, 2025.

*Primary Examiner* — Joshua D Huson
(74) *Attorney, Agent, or Firm* — Butzel Long

(57) ABSTRACT

A self-propelled and stabilized remote-controlled device is provided, that includes a spinning rotor and a separate platform above the spinning rotor that is rotationally stabilized to provide the device with an evident orientation to the user on which to base controlled movement. The device is suitable for use as a toy or similar novelty and suited for use in battle-type games between devices of a similar type.

18 Claims, 20 Drawing Sheets

(56) References Cited

U.S. PATENT DOCUMENTS

| | | | | |
|---|---|---|---|---|
| 2014/0014767 | A1* | 1/2014 | Yan | A63H 30/04 244/119 |
| 2016/0375983 | A1* | 12/2016 | Yan | G05D 1/0011 701/4 |
| 2018/0057135 | A1* | 3/2018 | Yan | A63H 15/06 |
| 2023/0060888 | A1* | 3/2023 | Yan | B64C 39/024 |

* cited by examiner

FIG. 15A
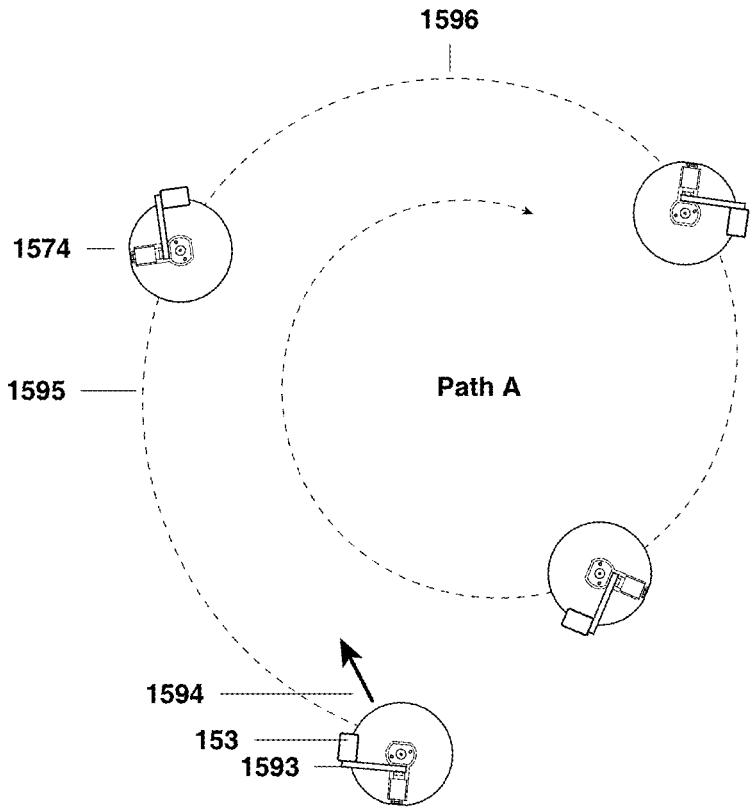
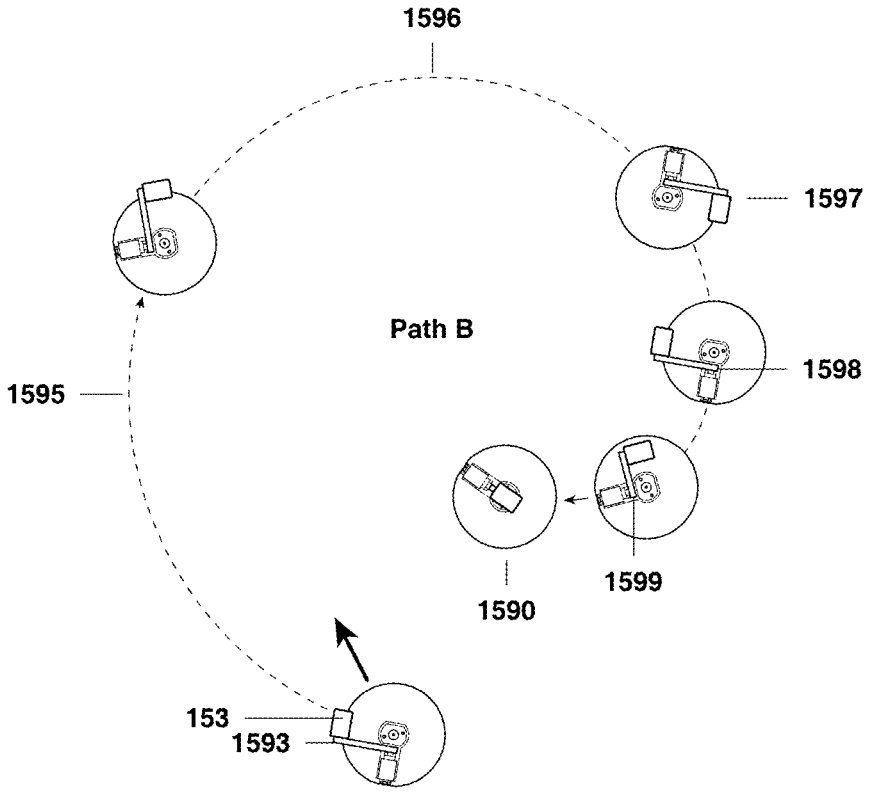
FIG. 15B

FIG. 16A
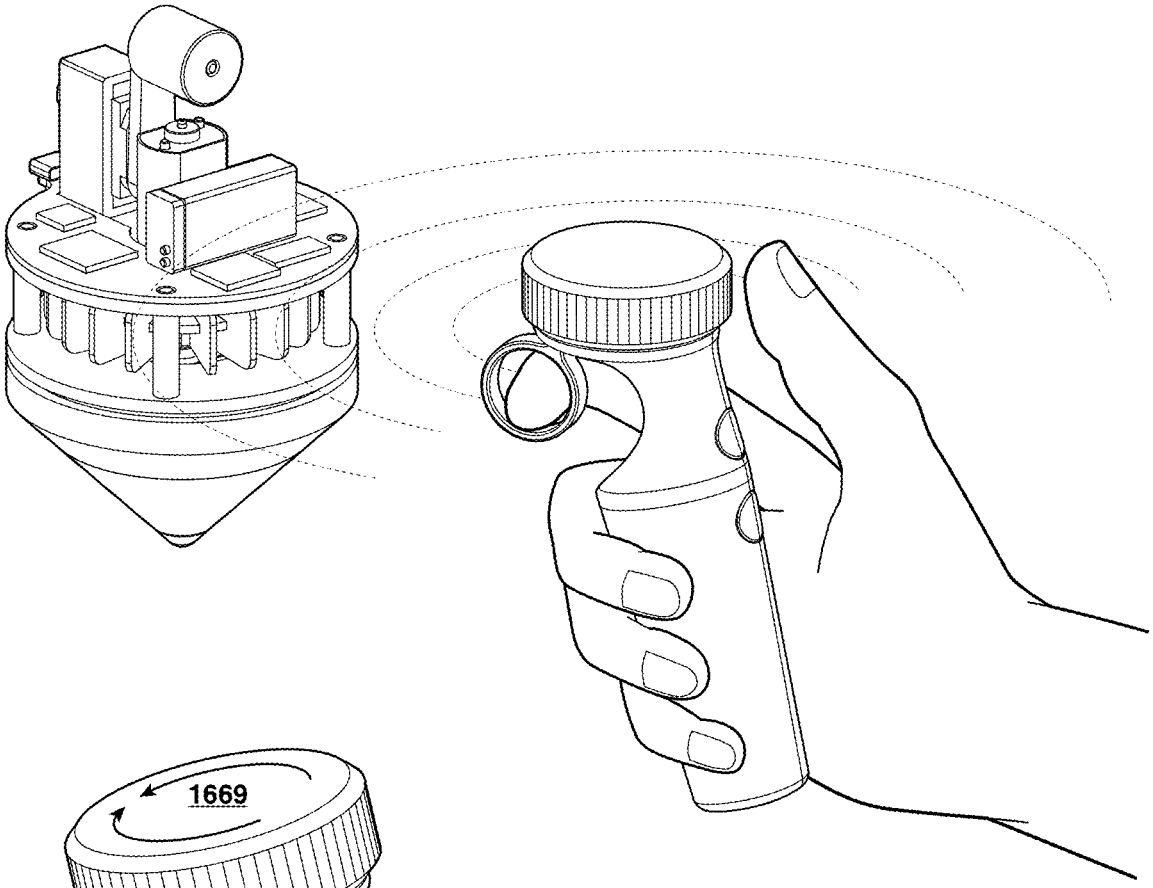
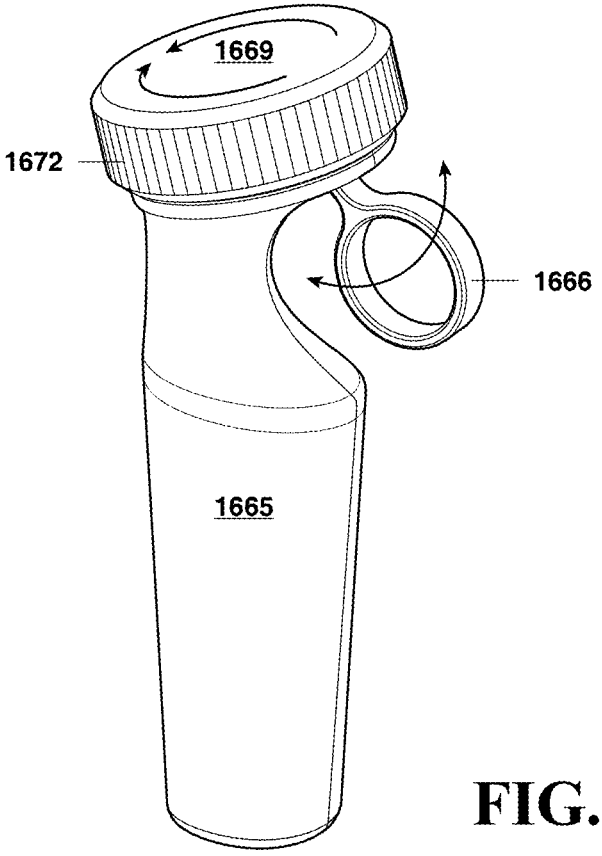
FIG. 16B

MOTION CONTROLLED SPINNING TOP

BACKGROUND

Various rotating toys and novelty items are known. For example, pull-string, balancing gyroscopes are well known as educational and entertainment items. Children's toys such as tops and yo-yos have been known for centuries across multiple countries and societies. More recently, electronic tops and "battle" toys have been disclosed, in which spinning devices are placed in a confined area in which they compete by colliding with one another. Such devices typically are started by mechanical or electrical means such as a launcher or other motor, after which they are allowed to rotate freely until running out of rotational energy or a sufficiently strong collision to knock the toy over, for example by reducing its rotation to the point where it no longer stays upright.

BRIEF DESCRIPTION OF THE DRAWINGS

FIGS. 14, 15A, and 15B show example paths that a device as disclosed herein may follow under various forms of horizontal movement control as disclosed herein.

FIGS. 16A-16B show examples of a remote control device as disclosed herein.

DETAILED DESCRIPTION

Embodiments disclosed herein provide devices, typically usable as toys or other novelty items, in the general form of a rotating "top" that can be controlled by the user. The devices include a rotating body and various components to counteract the undesirable counterrotation that typically acts on the device, and thereby achieve a stable, stationary mode of operation. Various embodiments then provide control options for the user, such as rotating the device orientation clockwise or counter-clockwise (i.e., changing the direction the device is "facing"), and/or total rotational momentum of the device, horizontal movement in any direction, and the like. In some embodiments, devices may interact with one another and/or with the user in various ways. For example, the devices disclosed herein may operate and be operated as "battle" toys that can engage with one another to cause simulated damage, such as by colliding with each other in various orientations; as vehicles in racing games, obstacle courses, or the like; or to play simplified sports games or simulations, and the like.

As described in further detail herein, devices as disclosed herein may include, for example, a first rotor arranged and configured to rotate around a primary axis of the device in a first rotational direction, the first rotor comprising a tip on which the device balances when in operation; a first chassis rotatably connected to the first rotor; a counter-rotor arranged and configured to exert a counter-rotation in a second rotational direction, rotationally opposite the first direction, when the counter-rotor is powered; and a controller arranged and configured to control the first rotor and the counter-rotor, based on a signal received by the controller, to control a rotational direction or speed of the device, a horizontal movement of the device, or a combination thereof.

Figure 1A:
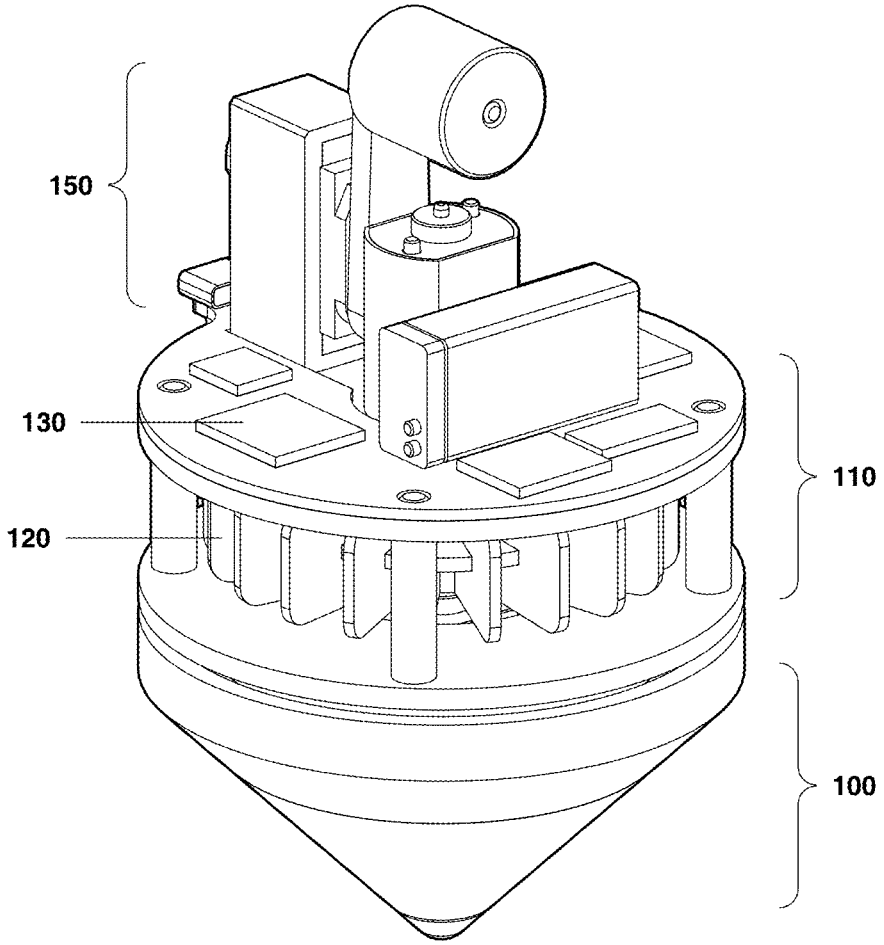
FIG. 1A shows an isometric view of an example of a rotationally-stabilized, controllable device as disclosed herein.

FIG. 1A shows an exploded view of an embodiment of a rotationally-stabilized, controllable device as disclosed herein, which may have the form of a spinning top or similar toy or novelty item. Although devices disclosed herein may take advantage of various gyroscopic effects, they provide additional control and operation capabilities beyond those associated with a convention gyroscope or other known gyroscopic toys and novelty items, as described in further detail below.

Figure 1B:
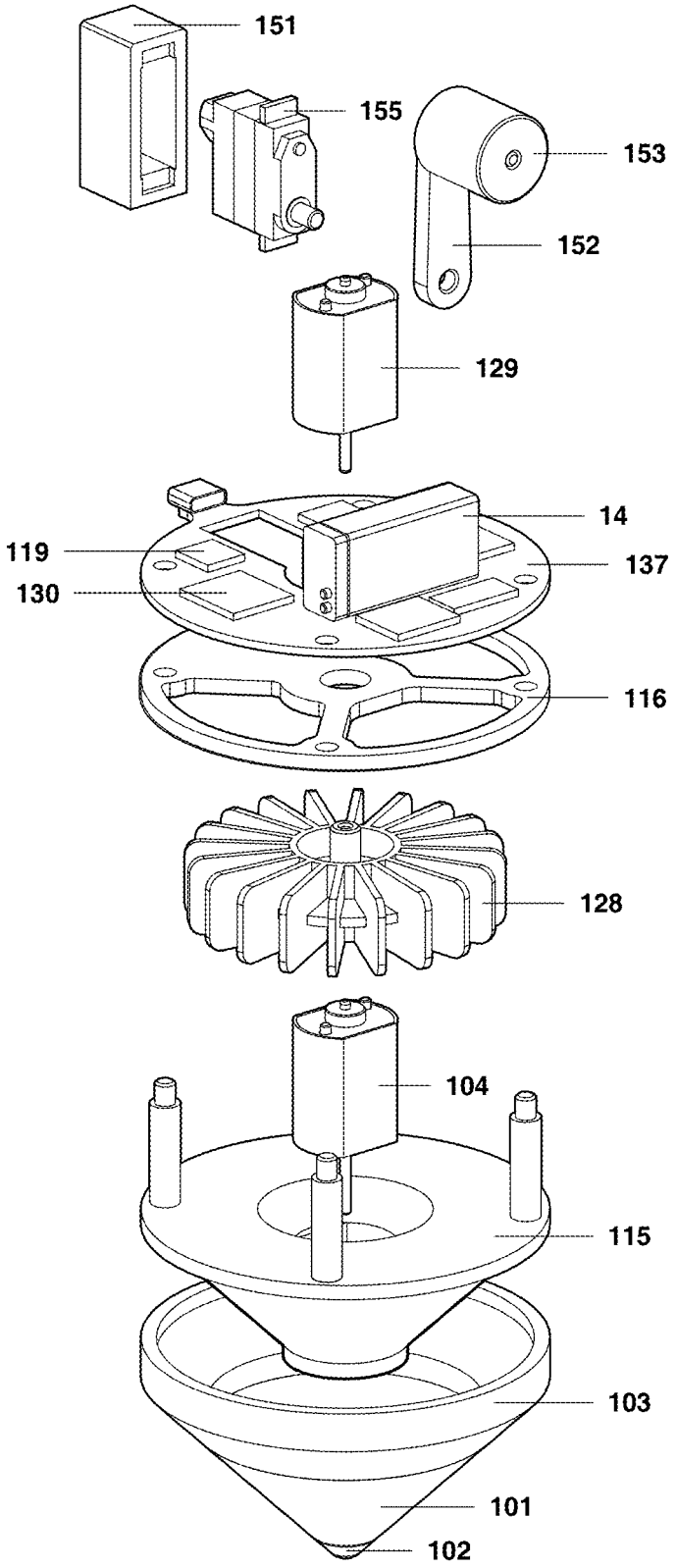
FIG. 1B shows an exploded view of the same device.

Generally, embodiments disclosed herein take the form of a spinning top that includes a balanced and/or weighted rotor attached to a tip at the end of the axis of rotation of the rotor, on which the device can balance and move across a horizontal surface. FIG. 1A shows an example of such a device without an outer protective and/or decorative cover. FIG. 1B shows an exploded view of the same device. The device includes a first rotor 100 connected arranged and configured to rotate in a first rotational direction. A chassis 110 formed by an upper chassis 116, lower chassis 115, and associated connecting components is rotatably connected to the first rotor 100 such that the rotor 100 can rotate independently of the chassis. A counter-rotor 120 is arranged and configured to exert a counter-rotation that is rotationally opposite the first direction, when the counter-rotor is powered. In the example shown in FIGS. 1A-1B, the counter-rotor includes a centrifugal fan 128 driven by a motor 129, but other variations may be used as disclosed herein.

A controller 130, such as a processor installed on a printed circuit board (PCB) 137, which may include other sub-processors, communication chips, sensors, and the like as disclosed in further detail herein, may be arranged and configured to control the first rotor and the counter-rotor, such as based on a signal received by the controller, to control a rotation of the device, a horizontal movement of the device, or a combination thereof. As explained in further detail herein, such movement may be achieved by changing the relative speeds of the rotor and the counter-rotor, by moving a mass within the device, and/or by changing the operation of other components of the device such as other fans or the like. The controller 130 may be a single specific- or general-purpose processor, or it may be multiple processors, sub-processors, microprocessors, or the like operating in conjunction to provide the operations disclosed herein. The processor may include, or may be in communication with, data storage devices such as solid state devices or the like, communication components such as Bluetooth, WiFi, radio, infrared, or the like, and other electronic components known in the art. Hence, a "controller" as disclosed herein may encompass any such arrangement of one or more processors configured to operate as disclosed herein.

The primary spinning top rotor 101 may be rotated by a motor 104 that imparts rotational energy to the rotor. The motor 104 typically includes an electric motor with or without gearing. The motor 104 causes the spinning top rotor 101 to accelerate to a typically steady rotational velocity, such that when it is placed upright on a horizontal surface, with its central rotating tip 102 contacting the play surface, the rotor creates a gyroscopic effect that may balance and stabilize the vehicle vertically. During typical operation of the device in which the device is upright and the rotor is spinning, the rotor drive motor 104 typically drives the rotor 100 relative to the chassis 110 at a significant rotational velocity, typically in the range of about 2,000-8,000 revolutions per minute. This driving torque is applied between the two most significant masses of the overall vehicle, typically the rotor 100 and the chassis 110 and its attached components. The ongoing rotation of the rotor typically keeps the device upright via the gyroscopic effect.

In some embodiments, the rotor 100 may incorporate a higher density material concentrated at its circumference 103. This may increase or maximize the rotational inertia of the rotor for a given overall size and weight. The circumference material may be a different, denser material, such as brass or another heavy metal, compared to a typically lighter material for the rest of the rotor 101, or simply a thicker region of the same material as the rest of the rotor. The circumference material may be distributed along the top portion of the rotor 101 as shown, or it may be distributed in one or more bands around the outer edge of the rotor 101 in any desired configuration for functional and/or aesthetic purposes.

The rotor 100 includes a contact point tip 102, which typically is the only portion of the device in contact with the horizontal operation surface during operation of the device. The tip 102 may be hemispherical, parabolic, hyperbolic, or any other curved or pointed shape. The tip 102 also may be formed from a different material than the body of the rotor 101. For example, it may be made from a fully spherical ball bearing embedded in the tip of the rotor body, as an economical way to obtain a spherical or near-perfect spherical shape, as well providing increased resistance to wear from operation and use of the device.

Figure 1C:
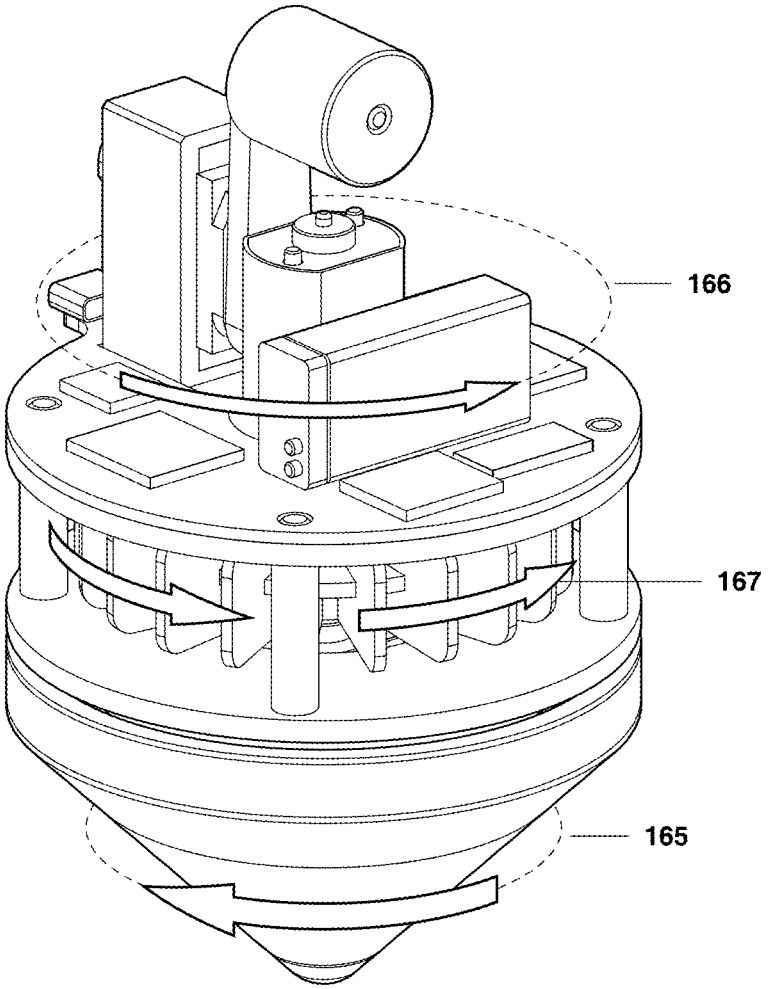
FIG. 1C shows an example of the same device in operation.

FIG. 1C shows an example of the device shown in FIGS. 1A-1B during operation. While the rotor 101 continues spinning in a first direction, for example a clockwise (CW) direction 165, the chassis and other chassis-attached components will reactively counter-rotate in the rotationally-opposite direction 166. Unless indicated otherwise herein, the various examples provided will describe rotation in terms of clockwise and counter-clockwise rotation relative to the initial CW/CCW rotation shown in FIG. 1C. However, it will be understood that the rotational directions can be reversed without any loss of generality and without departing from the scope and content of the present application. Such movement is known in the art and observed in conventional spinning-top style toys and other novelty items. To advance from this conventional electric/powered spinning top configuration, embodiments disclosed herein provide arrangements and techniques that allow for the chassis to remain rotationally static in relation to the ground or other horizontal use surface, opposing its tendency to counterrotate 166 given the torque imparted on it by the rotor, and its lack of mechanical connection to any external stable body. As disclosed in further detail herein, when the chassis is kept rotationally still, other forces may be applied to the chassis to instigate and control tilt of the vehicle and the resultant motion. Without a rotationally still chassis, it is difficult to apply any force or torque to be applied to the chassis in a consistent direction relative to the external world. Nor is it possible for the user to ascertain which direction the vehicle is facing, and hence control in specific direction(s) is difficult or impossible.

Such rotational stability may be achieved through use of a counter rotor 120. FIGS. 1A-1C show an embodiment in which the counter rotor 120 includes a second motor 129 mounted co-axially on the chassis, in this example above the primary rotor motor 104, which is connected to another rotational component in the form of the centrifugal fan 128.

In some embodiments, the counter rotor may also provide an inertial wheel when it is accelerated or decelerated, proportional to its weight and moment-of-inertia. As described in further detail herein, this effect may be used to intentionally rotate the chassis in either rotational direction, thereby providing some degree of "yaw" steering the chassis around the central axis of the device, by momentarily accelerating or decelerating the motors 104 and/or 129.

As described in further detail below, devices according to various embodiments also may include a horizontal motion control 150. This component, or set of components, may allow for movement of the device across a horizontal or essentially horizontal plane on which it stands. For example, in the embodiment shown in FIGS. 1A-1C, a mass 153 is attached to some form of actuator 155 by an arm 152 that can move that mass in a controlled fashion—such as via a rotary or linear servomechanism. The actuator 155 and associated electronics may be held in a servo mount block 151 or equivalent housing within the device.

Devices disclosed herein also may include various conventional components, such as a battery 14, which may be user-replaceable. Various control circuitry and other components may be included on the PCB 137 as previously disclosed and as explained in further detail herein.

Still referring to FIGS. 1A-1C, in an embodiment the counter rotor is powered by a motor 129 connected to a centrifugal fan 128, which also rotates around the central axis of the device. The centrifugal fan 128 may be designed to impart significant friction against the air, thereby providing counter-rotational torque. For example, if the rotor 101 is configured to rotate in a clockwise direction, the centrifugal fan 128 may be configured to rotate in a counter-clockwise (CCW) direction 167 as shown in FIG. 1C, thereby providing a CW torque to the chassis that balances against the CCW torque effect of the rotor spinning in a CW direction 165. When correctly balanced, these two torques result in a rotationally stabilized (still) chassis. Generally, a centrifugal fan 128 as shown in this example includes a plurality of blades arranged vertically around the central axis of the device as shown, i.e., perpendicular to the rotation of the fan, so as to create the desired friction against ambient air.

Unlike a conventional impellor or propellor, the centrifugal fan in this example is not intended to push air or other fluid through the fan's axis (top-to-bottom in this arrangement), or out to the sides or in towards the center, though some amount of such airflow may be unavoidable as a side-effect. Rather, according to this embodiment the centrifugal fan is designed and arranged to generate friction against the surrounding air, thereby creating significant resistance to the rotation of the fan such that appropriate rotational torque is exerted on the motor 129 and attached chassis when the fan is spinning.

In an embodiment, the centrifugal fan may include a set of angularly pitched blades that push against the surrounding air to create a form of rotary thrust or the summation of subsequent linear thrusts at each blade tangential to the circular motion of the fan. This thrust creates a reaction torque that travels back through the centrifugal fan hub, motor and chassis. This counter-torque may be equal in magnitude but opposite in rotational direction to the undesirable torque caused by the rotation of rotor 100. Accordingly, the counter-torque may suppress rotation of the chassis and thereby allow for operation in a stable state as previously disclosed. The net total torque still may be "overridden" by the intentional yaw (rotational orientation) control disclosed herein, based on control signals provided by a user.

Figure 2:
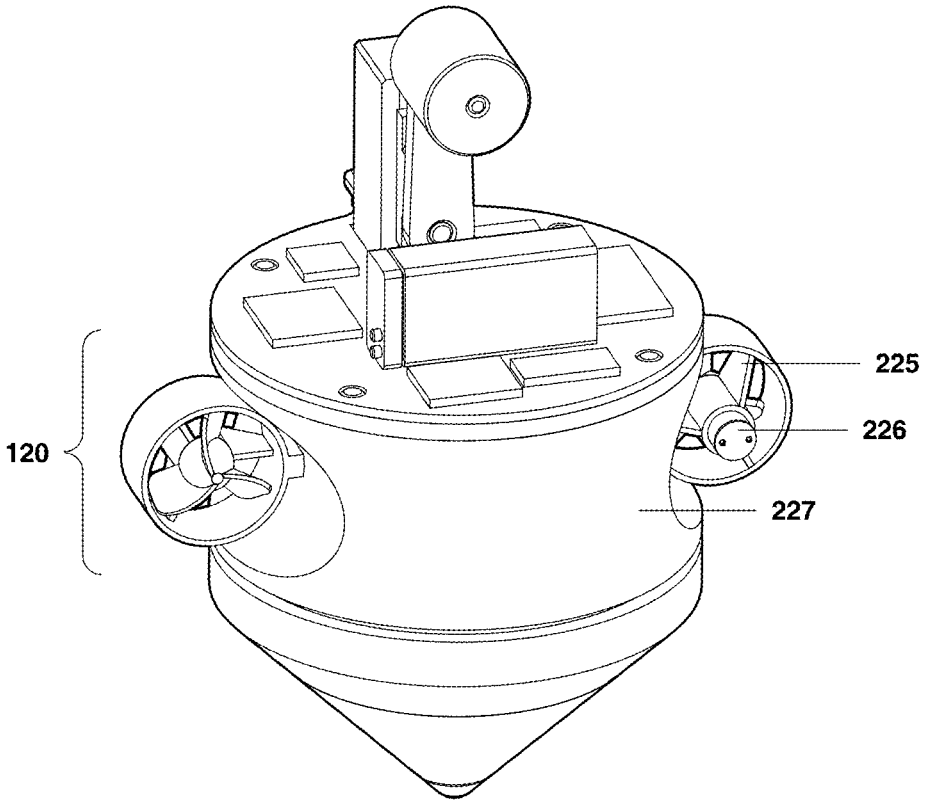
FIG. 2 shows a device as disclosed herein, in which fans provide a counter rotor force.

Various other components and arrangements may be used to provide the counter rotor 120. FIG. 2 shows an embodiment in which fans provide the counter rotor force. In this embodiment, two or more fans 225, typically powered by separate motors 226, are positioned equidistant around a circumference on the platform. The motors may be disposed in and protected by a housing 227. Together, they impart an overall rotational torque on said platform by blowing air in directions tangential to the circumference of the vehicle. Following the example directions initially described with respect to FIG. 1, the fans 225 may provide an overall rotational torque in a clockwise direction. As previously disclosed, the overall operation and relative force applied by the fans 225 in this counter rotor 120 may be controlled by the controller 130, for example in response to control signals received from an operator of the device.

Figure 3A:
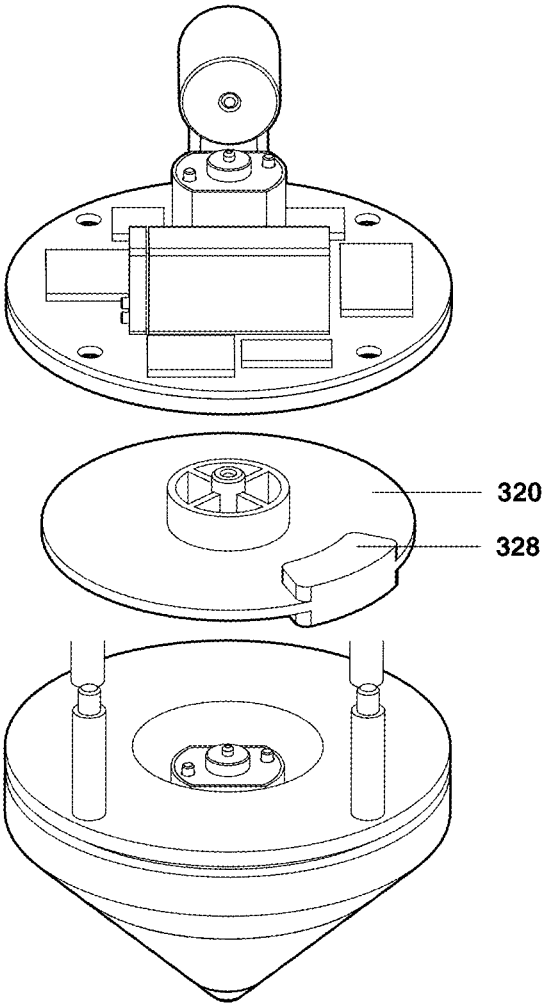
FIG. 3A shows an example of a device as disclosed herein, which includes a weighted disk having an offset mass.
Figure 3B:
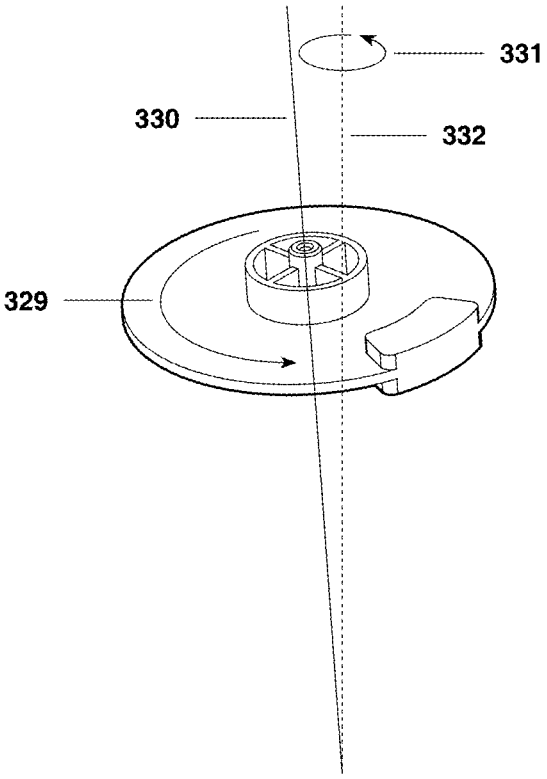
FIG. 3B shows an illustration of motion of a device as shown in FIG. 3A.

In an embodiment, the counter rotor 120 may be provided by a disk or other essentially planar component having a mass offset from the center axis. FIG. 3A shows an embodiment that includes a weighted disk 320 having an offset mass 328, which is connected to the counter rotor motor 129 as shown in FIGS. 1A-1C. The mass 328 is intentionally not symmetric or uniformly arranged around the center axis of the device. As shown in FIG. 3B, by rapidly spinning the offset mass in a CCW direction 329, the primary rotational axis 330 of the device is made to move in a conical fashion as shown at 332, pivoting on the contact point where the rotor tip 102 shown in FIGS. 1A-1C contacts the surface. The overall device and the offset mass 328 effectively "orbit" one another, i.e., rotate around the center of mass of the entire device, balanced overall around the true vertical axis relative to the ground surface and the direction of gravity, shown at 332 in FIG. 3B. The orbiting motion 331 typically has a very small diameter relative to the size of the device and typically would be very fast, depending on the speed of the motor 129. Accordingly, the orbiting motion would be apparent to an observer as a very slight, but rapid, wobble of the center axis of the device in comparison to the essentially still, non-rotational motion of the same axis in other embodiments. This motion may be undesirable in some embodiments but may be tuned to be so slight as to have minimal aesthetic or performance impact.

Through the orbital action of this offset mass versus the rest of the vehicle, a small resultant torque applies to the chassis through the motor 129, acting as a torque force to counterbalance the inherent counterrotation that occurs to the platform. Typically the offset mass will be less than the overall mass of the vehicle, and the speed of the motor 129 will be higher than the speed of the primary rotor 101. An advantage of this arrangement is that it avoids the need for fans as described in previous arrangements, which may be quieter and allows the mechanism to be more easily encased in an outer shell or housing. In contrast, fans and the like require some direct access to ambient air, which may place structural limitations on any outer housing that may be used as described in further detail herein.

Figure 4:
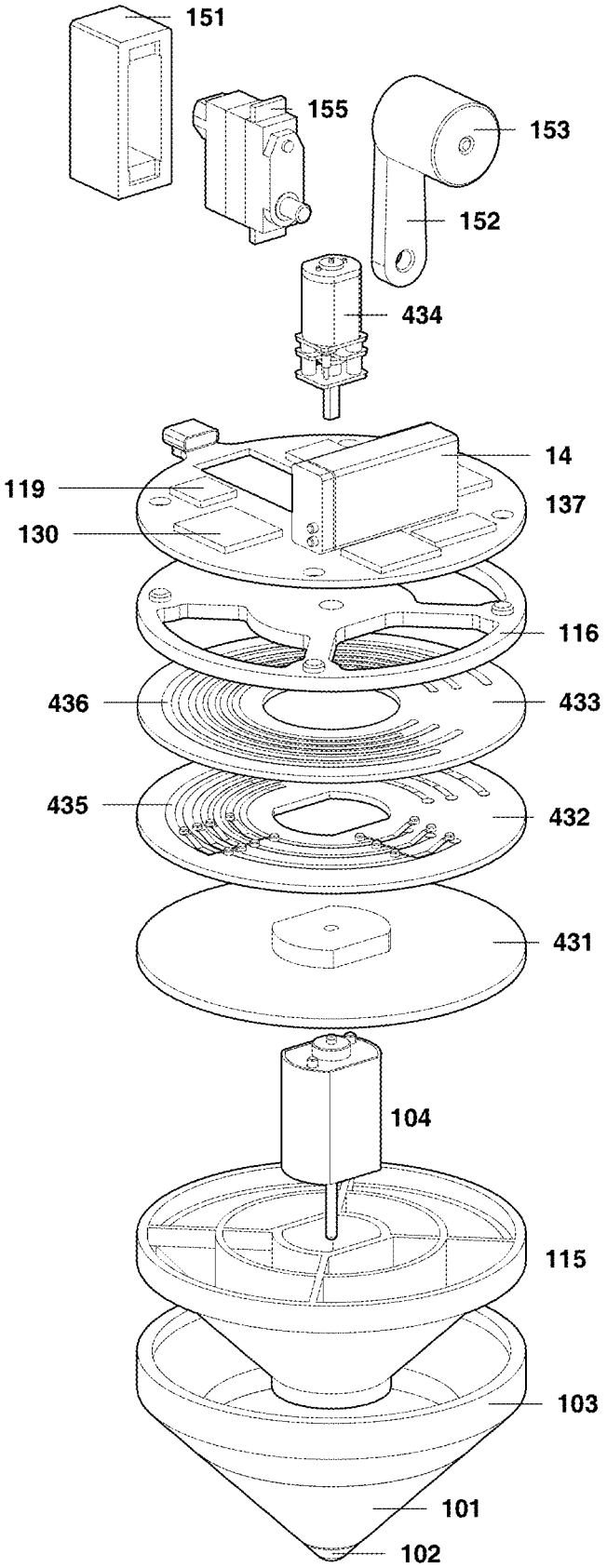
FIG. 4 shows an exploded view of an example device as disclosed herein in which a counter rotor is provided by a separate rotational stage.
Figure 5:
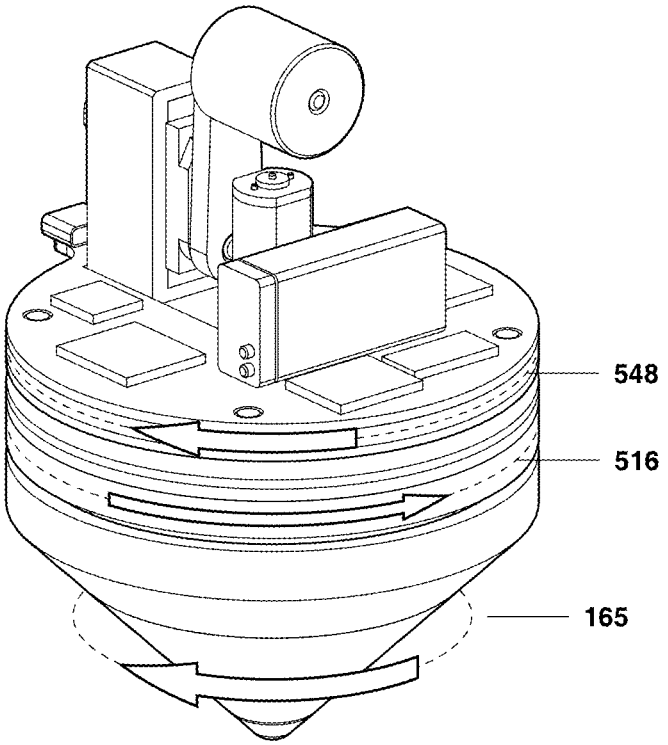
FIG. 5 shows the same device in compact form with an indication of relative rotational directions of the stages.

In an embodiment, the counter rotor 120 may be provided by a separate second rotational stage. FIG. 4 shows an exploded view of an example device having such a configuration; FIG. 5 shows the same device in compact form with an indication of relative rotational directions of the stages. In this embodiment, a low reduction gearmotor 434 may be mounted to the upper chassis 106, co-axial to the lower chassis 115, completely separating the two and controlling differential motion between them. An additional cover 431 may be disposed over the chassis 115, with a center hole at the lower level to accept the shaft of the gearmotor 434 to allow the transmission of torque and completing the mechanical interface. To transmit electrical energy between the separate levels of the device while still permitting continuous rotation via the gearmotor shaft, a lower and upper slip ring PCB 432, 433, respectively, may be disposed at the interface spanning the air gap between the two. The slip rings 432, 433 have electrically conductive contacts 435, 436, respectively, that mate and slide past each to enable electrical continuity between levels. If conventional insulated jumper wires were used, they would twist into a knot disabling free and continuous rotation.

While the motor 104 creates rotational motion using energy from the battery 14, the rotor 101 will continue spinning in a CW direction 165 as shown in FIG. 5 and as previously disclosed with respect to FIG. 2, and the lower chassis 105 will counter-rotate in the CCW direction 516. Hence, it is still desirable to provide for the upper chassis 106 to remain at a set angular position in relation to the ground or to observers nearby. In this embodiment, the gearmotor provides a CW motion 548 to the upper chassis 106 that opposes the CW motion 516 of the lower chassis 105. When the motions are equal in magnitude and opposite in direction, they combine and cancel as previously disclosed to produce an upper chassis having little or no sum total angular motion.

In comparison to other embodiments, this arrangement uses multiple chassis levels, sub-assemblies or bodies in a sequential, serial and coaxial chain. Such an arrangement allows for direct and linear control of the rotational motion of the device through the chain without fluid interaction losses or whirling vibration. Because of the direct coupling, the torque required to set the upper chassis to a fixed angular position or to move with angular velocity and acceleration is limited only or primarily by the gear ratio and performance of motor 434.

In the arrangement shown in FIG. 1 and other similar arrangements, the rotor 100 and chassis 110 are connected by a single central axle, which can either be the same axle and bushings/bearings of the motor 104, or a separate axle with one or more bushings or bearings holding it in the center and the motor attached via any form of gearing, belt, chain friction or other drive mechanism to the axle. The rotor 100 and the chassis 110 and attached components typically form the two heaviest and largest overall bodies of the device. Further, typically one or both are rapidly rotating during operation of the device. As a result, the axle and its supporting bearings or bushings may be subject to significant twisting or bending loads and impacts, especially when the device impacts with others in a "battle" scenario, or if the device impacts fixed obstacles in the environment, or if the device drops from an elevated play surface such as a table onto the floor. Due to the range of sizes in which the device may be made, the axle and its supporting bushings and bearings may be relatively quite small, especially if the motor's inbuilt axle and bushings/bearings are used to serve as this key mechanical connection in the device—and hence more vulnerable to damage from such shocks or impacts.

Figure 6:
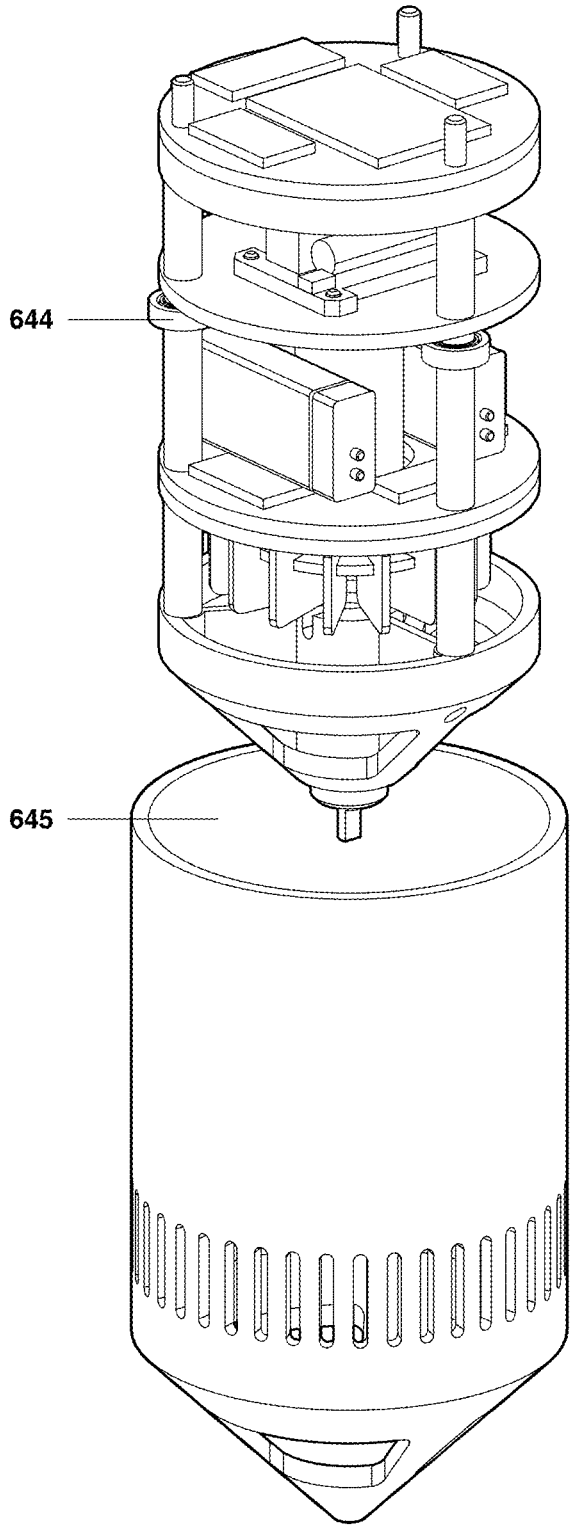
FIG. 6 shows an example of a device as disclosed herein that has a can-shaped rotor.

To address these potential issues, an embodiment may use a similar attachment of rotor and axle but a far taller "can" shaped rotor. Such a device is shown in FIG. 6. The illustrated arrangement includes a taller rotor 645, coupled with a set of three or more equally-spaced supporting bearings or bushings 644 that act as glides against which the rotor's inner surface or contact ring can run. This allows the rotor 645 to be supported by the chassis at this higher level while still moving with very low contact friction. In this configuration, if an impact or fall causes extreme shock to any point on the rotor, that shock is transmitted to the chassis 110 and the device overall, rather than subjecting the potentially thin axle to the entire force of the impact. This configuration also allows for the mass of the rotor 645 to be incorporated into the taller "can" shape as shown, so that much of the mass of the shape is close to the circumference. The "an" rotor shape may include a cylindrical wall that extends around the first chassis, which may provide additional protection to the chassis and other components. This shape also increases the moment of inertia of the rotor, without the need for different denser material as described with respect to the weighted circumference 103 of the rotor 100/101 as previously disclosed.

Generally, the precise torque driving the counterrotation of the chassis 110, and hence the torque required by motor 129 and/or 434 to balance out that counterrotation, may not be constant. For example, it may be affected by the velocity and acceleration of the main rotor 100 by the primary motor 104 during startup, by the air resistance on all moving components of the vehicle, by the friction of the tip 102 of the rotor 101 on the play surface (which may vary), and also by the lean of the device relative to vertical and the associated precession and nutation effects of the device acting as a spinning top. Accordingly, in an embodiment, it may be desired to have more precise, real-time control over the relative rotational speeds of the various components in the device by incorporating an Inertial Measurement Unit (IMU) 119.

The IMU may be connected to an appropriate microcontroller 18, which may be integral with or provided by the controller 130, or other electronic control system, to determine the correct control signal and electrical power to apply to motor 129 that optimally sets the rotation of the chassis to zero around the vertical Z axis. The IMU 19 may continually measure accurately any rotation $\omega_{2\ IMU}$ of the chassis around the vertical Z axis, i.e., the primary axis of rotation of the device. That measurement may be used as input to a conventional PID closed-loop control system as is generally known in the engineering and electronic control arts. The PID system may be implemented as software running on a microcontroller on the PCB 137, such as controller 130, but also may be implemented as hardware-based digital or analog control electronics. The PID system provides for the required electrical power to be sent to the motor 129 to result in a rotationally still chassis or a desired controlled rotation as described in further detail herein. Electrical power provided to the motor to control its speed and torque may be applied as either a varying voltage, a varying current, or as a varying duty cycle of PWM (pulse-width-modulated) pulse.

The use of an IMU and/or PID system also may allow for the user to control the rotation (yaw) of the vehicle around its primary vertical axis of rotation, i.e., the vertical z-axis of the device. By inserting an offset amount into the desired rotation value ($\omega_{2\ Desired}$) in the control system, a user may control the rotation of the vehicle's chassis in either direction at a certain rate, or return to stable, zero-rotation state, for example by removing their input on any control (i.e., enter a "hands off" mode). As disclosed in further detail herein, the device may be arranged and configured to return to a stable state, such as one having no relative rotation, if input from the user stops. Any suitable remote control device may be used, such as by way of a conventional remote control device for other remote-controlled toys such as cars, boats, and the like. For example, a remote control input may be provided based on the offset on any form of electronic remote control, e.g. as a joystick or wheel offset on a conventional remote control, as buttons, sliders, wheels or joystick on a touch screen, slider offset, joystick position, tilt angle on a smart phone, tablet or PC, or as a hand, body or eye gesture read by optical or other sensors on the vehicle itself. Such remote control input is typically received by the controller 130 or other similar component via a wireless signal (such as Bluetooth, WiFi, or the like), and added to the ($\omega_{2\ Desired}$) value. More generally, any wireless communication chip and/or protocol may be included and implemented in the device, such as on the PCB 137, and arranged in signal communication with the controller 130 and other electrical components of the device, whether incorporated on the PCB 137 or separately arranged within the device.

The user input may be combined with the feedback of the PID control system to provide an over or under-supply of power to the motor 129, in comparison to the power required in a steady-state configuration to achieve zero rotation. Accordingly, the user input may result in a controlled rotation (CW or CCW) for as long as the user requests a particular rotation direction and speed. The effect may operate similarly to the yaw control of a helicopter, where the user can rotate the vehicle around its rotor axis freely in either direction, or stabilize rotation by releasing their offset input on that control.

Alternatively, the motor 129 could be set at a stable speed and allow for yaw control of the device by changing the speed of the motor 104. This also has a significant, but predictable, torque effect on the chassis. It may be desirable to limit the extent to which the speed of the motor 104 is decreased, because slowing the rotor 101 too far may reduce the gyroscopic effect enough that the device ultimately will fall over. For example, it may be desirable for the controller 130 to be programmed to gradually return the motor 104 to a preferred mid-point speed in the absence of user input to the contrary, or if the user input would exceed a predetermined threshold that would cause the device to become unstable. Furthermore, the motor 104 may only have power sufficient to achieve a certain maximum speed of rotor 101, beyond which further acceleration to achieve a yaw steering in that direction may be impossible.

Alternatively, the closed-loop control system described above may be used to control both motors 104, 129 to achieve even more pronounced momentary torque effects on the chassis. Such an embodiment may allow for faster and more dramatic yaw acceleration of the chassis.

More generally, the closed-loop control system is not mandatory in a device as disclosed herein. For example, a device as disclosed herein that allows for user control of the motors 104, 129 may rely solely on user input to control the yaw rotation of the device. Such a device may require greater user skill and/or attention to maintain the device in an upright position. Effectively, the user may be required to provide their own closed-loop control system that relies on visual observation of the chassis instead of relying on electronic measurement and stabilization, such as utilizing an IMU as previously disclosed.

User input and closed-loop controls also may be used to control components used in other arrangements of devices as disclosed herein. For example, user input and/or closed-loop control may be applied to the motor 434, the centrifugal fan 128, the fans 225, or any other components used to provide the counter-torque as previously disclosed.

Figure 7:
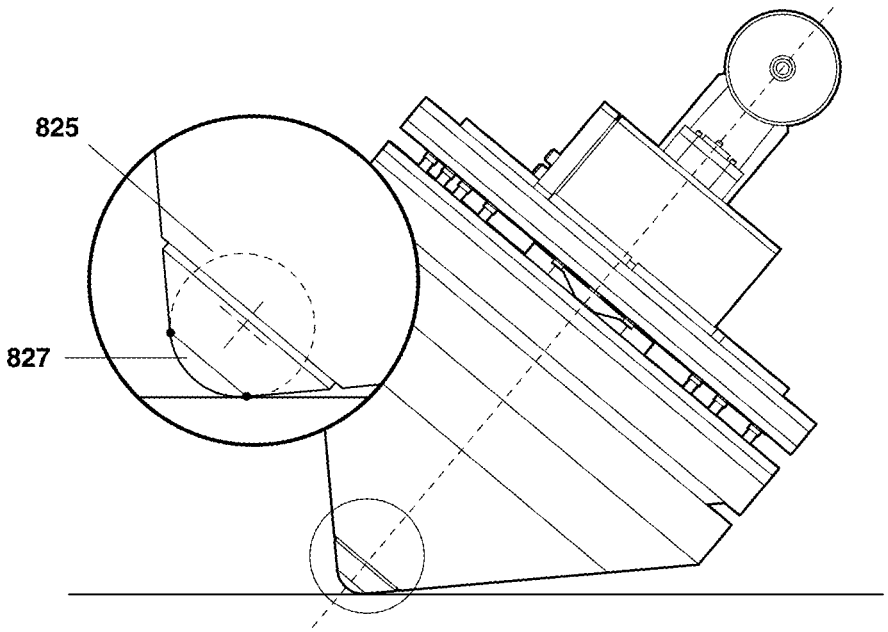
FIGS. 7 and 8 show detail views of examples of different-sized tips used in conjunction with devices as disclosed herein.
Figure 8:
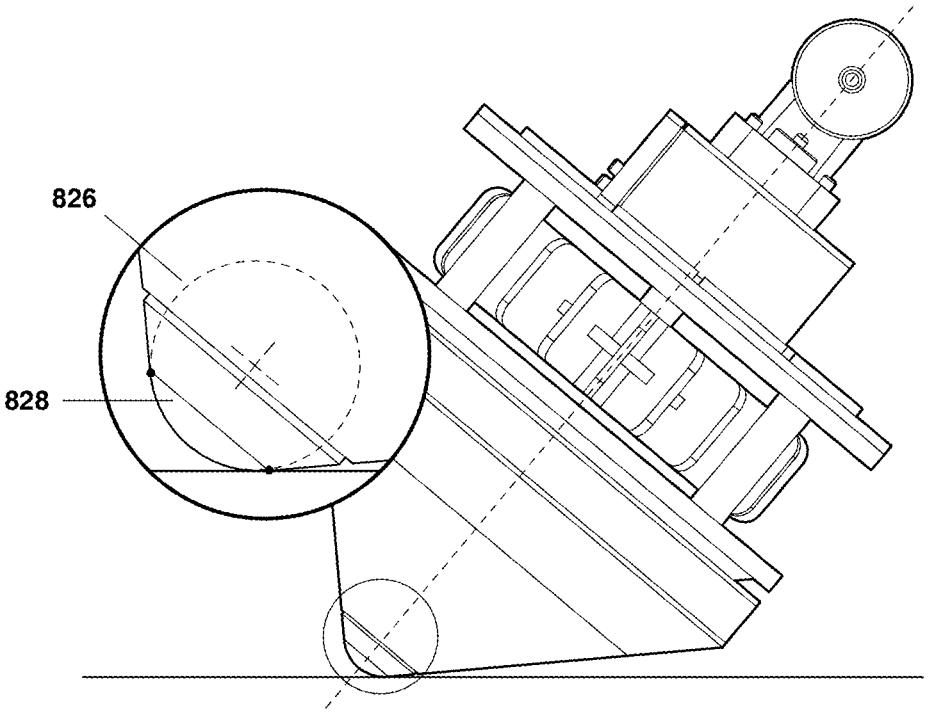

In an embodiment, the rotor 100 or a portion of the rotor may be replaceable with different styles and forms. For example, the weighted circumference 103 of the rotor may be separately replaceable to allow for the use of different weights on the rotor, thus allowing for different rotational behavior. Such a feature may be desirable where the device is used as a "battle" toy, to allow for further customization of the behavior of the toy when engaged with other toys that may have different configurations. As another example, the tip 102 of the rotor 100 or the entire rotor assembly 100 may be replaceable to allow for the use of different style tips. For example, it may be desirable to change the radius or curvature of the tip 102 to suit play areas of different sizes, materials, textures, or the like. FIGS. 7 and 8 show examples of differently-sized tips 102. FIG. 7 shows an example of a smaller tip, as seen in the inset detail; FIG. 8 shows a relatively larger tip as shown in the inset detail. As illustrated in FIGS. 7-8, increasing the radius of the top from a smaller example 825 to a larger example 826 will, for a given motor speed and lean angle, cause the device to move across the play area at a higher velocity, similar to increasing the size of the wheels on a car. This is because the contact line of the spherical tip on the surface increases to a larger circumference, from 827 to 828. A larger contact wheel will result in faster top speed for the vehicle and hence suit larger play surfaces. But conversely, acceleration may be slower as the larger contact wheel will place more torque load on the motor.

It also may be desirable to change rotors or rotor tips to different materials to provide appropriate grip on different surfaces with different levels of surface smoothness and friction, or to reduce the incidence of scratching or wear on different surfaces. The easy interchange of rotors and/or rotor tips may be achieved by a range of attachment mechanisms, such as interference fit of components, friction fit, conventional screw threads, grub or other fastener screws, clip fits, collet or chuck mechanism, or the like. As such, in some embodiments the rotor and/or rotor tip may be replaceable by a user of the device.

As disclosed herein, various embodiments of the devices provided herein allow for control of horizontal movement of the device in addition to control of rotational motion, by a user of the device via a remote control. Although some minimal horizontal and/or precessional movement may result from differences or changes in the relative rotational speeds of various components, more significant horizontal movement, and especially controlled movement across the play surface, generally is difficult if not impossible to achieve without the use of additional control components. When adequately powered and reasonably well balanced, a device as disclosed herein typically will tend to stay relatively still, with its central axis near-perfectly vertically aligned. Such a condition typically may be described as the 'sleep' state of a spinning top. Furthermore, it may be desirable for the controller 130 and/or associated control components to be configured to attempt to return to such a state in the absence of user input to the contrary. That is, it may be desirable for the device to have a "home" or default behavior that returns it to a horizontally-stationary, rotating state. More complex movement across the play surface, and especially movement under the control of a user, typically requires additional control structures as described below.

Figure 9A:
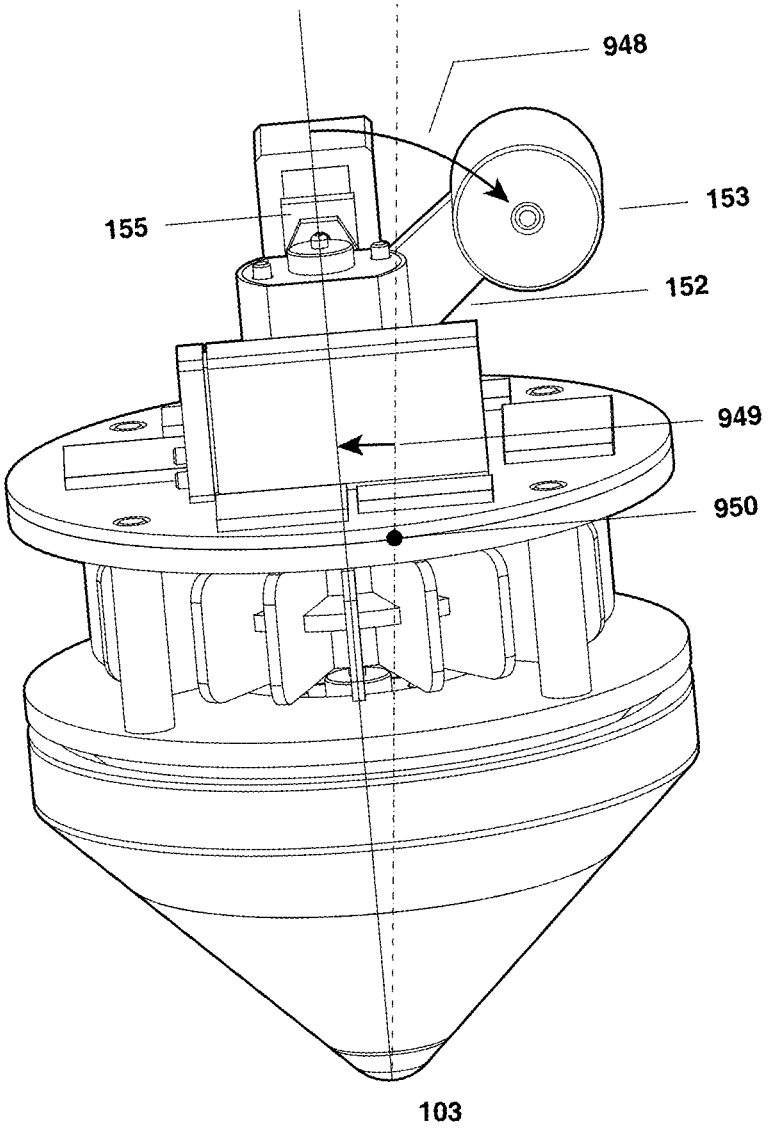
FIG. 9A shows a collapsed view of a device as shown in FIG. 1, with movement of a mass and resulting effects on the device.

Referring again to FIG. 1, in an embodiment, to initiate and control motion, a mass 153 may be attached to an actuator 155 by an arm 152 that can move that mass in a controlled fashion, such as by a rotary or linear servomechanism as described in further detail below. FIG. 9A shows a collapsed view of a device such as shown in FIG. 1, with movement of the mass 153 and resulting effects shown. If the actuator 155 moves the mass 153 from a start position centered on the chassis 110 (or which overall results in a center gravity of the device directly centered on the rotational z-axis of the device), to one side of the device as shown by 948, the device will lean slightly in the opposite direction as shown by 949, as an equal-and-opposite reaction to the inertia of that motion. This results in the device maintaining a net center-of-gravity 950 close to perfectly vertical above the contact point of the rotor tip 103 on the play surface, when steadied by the overall balancing gyroscopic effect of the rotor. Accordingly, the degree to which the device leans may be maintained for a sustained amount of time, for example until further changes are made to the arrangement of the mass 153, or until external forces affect the device.

Figure 9B:
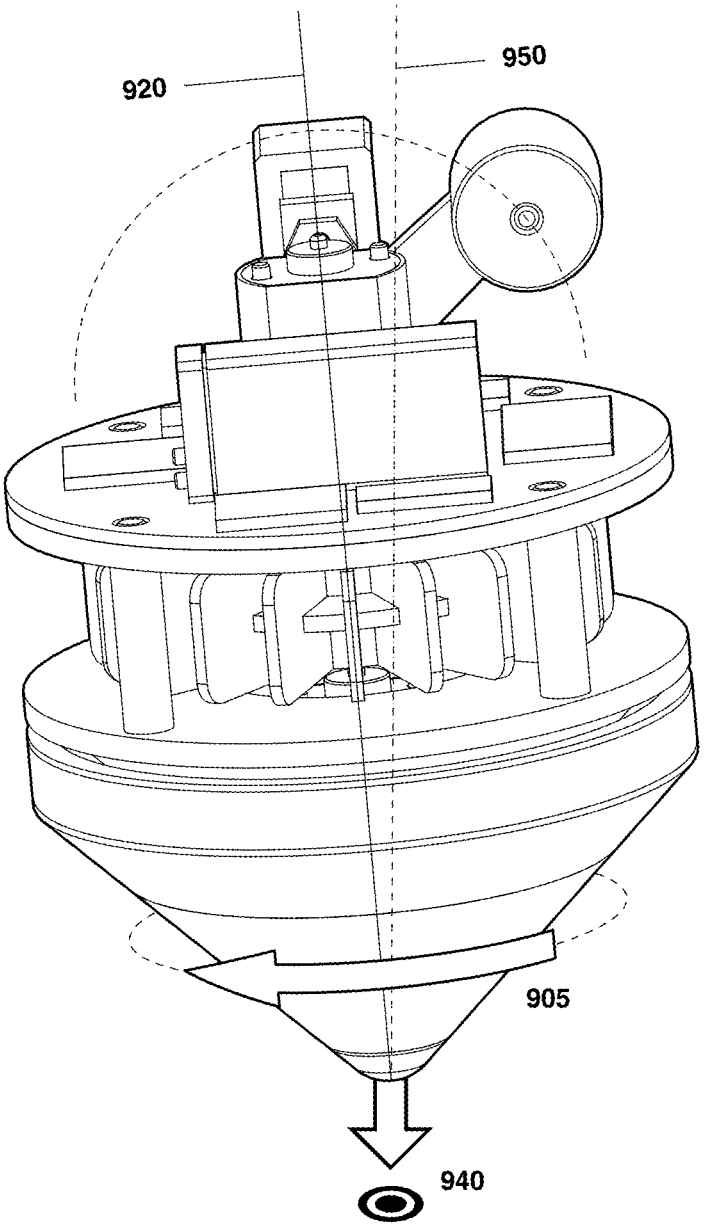
FIGS. 9B and 9C show examples of resulting motion of the same device.

Once a "lean" of the device and its rotational axis is initiated, the contact of the spherical tip 103 on the play surface may act as a small wheel to propel the device along the play surface. FIG. 9B shows an example of such motion. For a rotor spinning CW 905, with an offset mass tilted to the right when viewed from a "front" of the device at the perspective shown in FIG. 9B, and a lean of the rotational axis 920 slightly to the left relative to the play surface normal 950 as shown, the resultant motion will be forward, i.e., out of the page, as shown at 940.

Figure 9C:
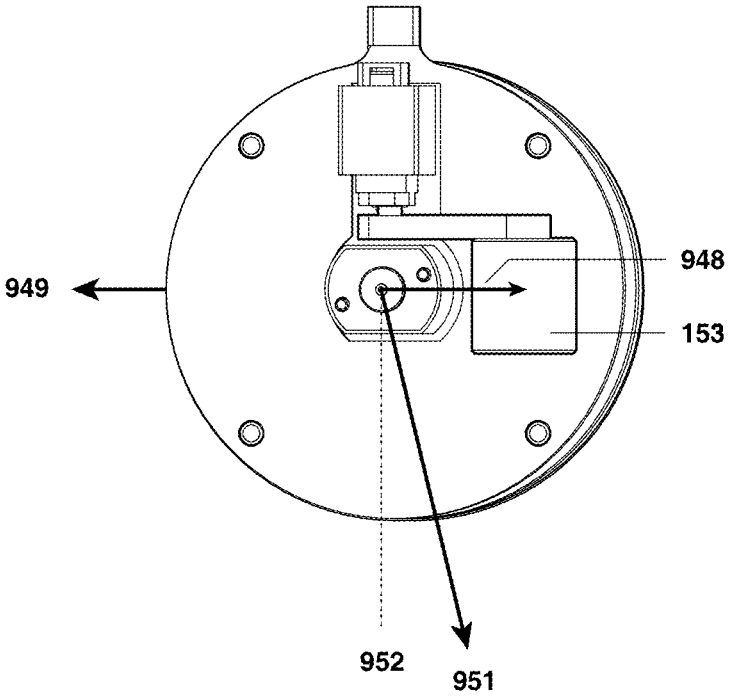

To achieve fully controllable motion, in addition to the primary lean 949 of the rotational z-axis of the device that gives a resultant perpendicular motion, the center-of-gravity of the device should also be tilted forward, i.e., in the direction of the desired motion horizontal movement across the plane. FIG. 9C shows the same device as 9B-9C viewed from above. For an offset of the mass 153 in direction 948 as previously disclosed, the resulting direction of motion 951 is slightly angled to the offset side of true (90 degree) perpendicular 952. The slight lean in the forward direction (i.e., the direction of intended horizontal motion) is similar to the support/balancing movement used by a unicyclist riding in a straight line at a constant speed, or when balancing a broomstick on a fingertip while moving forward at a constant speed. When accelerating from stationary, the forward lean counters the tendency for the device or balanced object to tip backwards (i.e., opposite the direction of horizontal motion), as the driving force in all cases is applied to the tip of the rotor (or fingertip contact point on the broomstick), which sits below the center of gravity. Once in steady forward motion, the tendency for the device to fall forward is balanced by the slight air resistance pushing back, thereby maintaining the forward motion of the device.

Figure 10:
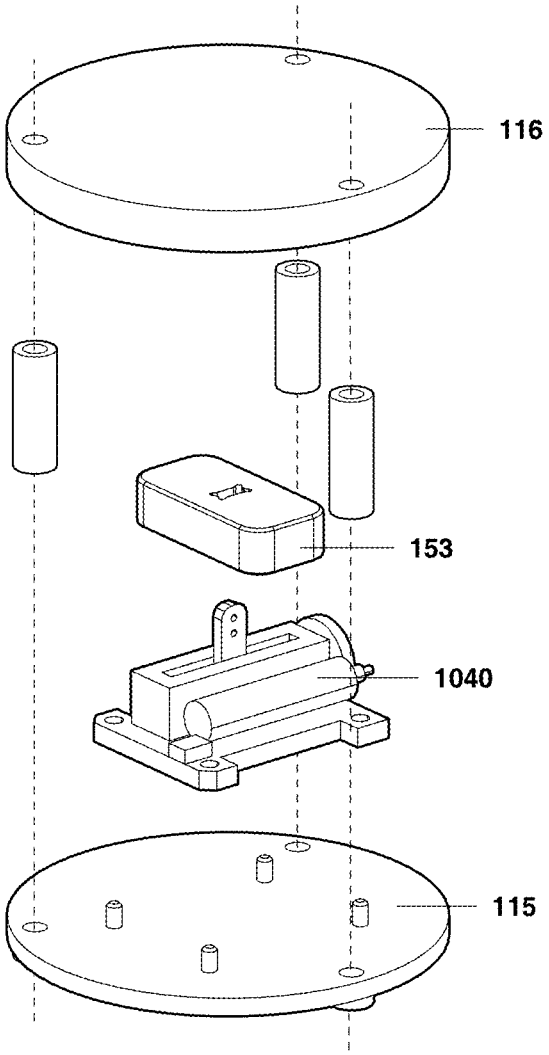
FIG. 10 shows an example of a linear actuator used to move a mass in a device as disclosed herein.

Alternatively or in addition to the use of an offset mass, other techniques and arrangements may be used to cause the device to tilt, and thus move, in a desired direction. For example, the mass 153 may be, or may include, other components shown and described in the device, such as a permanent or replaceable battery, which has sufficient mass to affect movement of the device as disclosed. As previously disclosed, the mass (whether separate or provided by another component) may be attached to a connecting arm 152. Alternatively, a mass 153 may be attached to a linear actuator 1040 as shown in FIG. 10. The actuator 1040 may be any mechanism that can move the mass 153 horizontally within the device in response to an electrical control signal. For example, the controller 130 may indicate a suitable movement of the mass 153 in response to a control signal received from a remote control or other user control signal. The actuator 1040 and associated mass, whether separate or provided by another component, may be arranged within the chassis 110 as previously disclosed, or elsewhere within a larger housing or chassis such as the "can" rotor 645 shown in FIG. 6.

Figure 11:
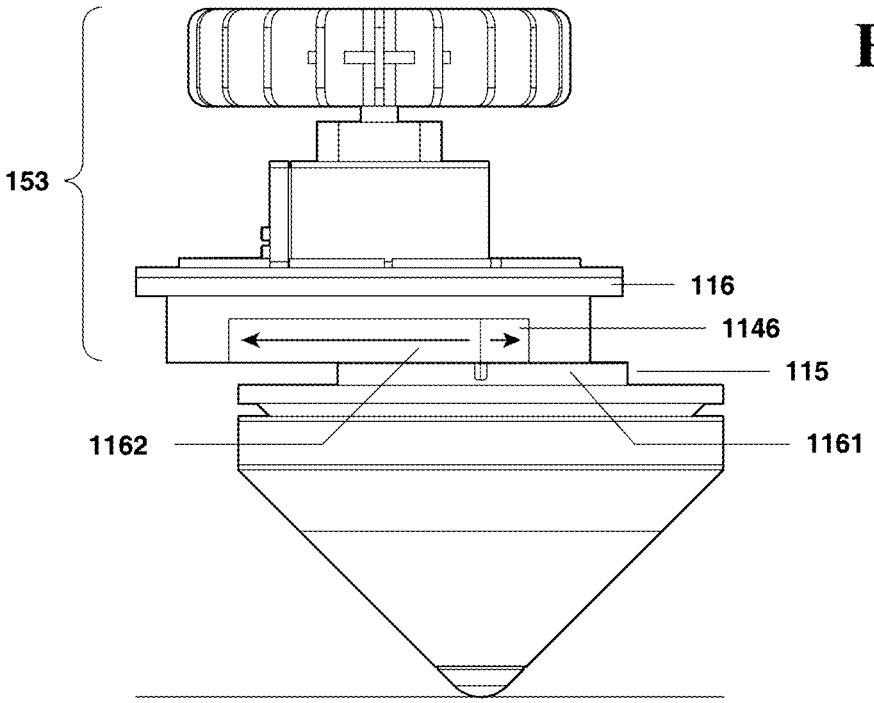
FIG. 11 shows an example of a device as disclosed herein in which different sections of the device are moveable relative to one another.

Instead of being provided by a single component, the offset mass 153 may be provided by multiple components, including the entire chassis 110 or the entire upper chassis 116 and related components. For example, the upper chassis 116 and the lower chassis 115 may be configured to slide laterally relative to one another as shown in FIG. 11. In such a configuration, the chassis components 115, 116 may be connected by rails, glides, or the like, via a linear servo 1146. The servo 1146 may be mounted on the upper chassis 116, with a displacing arm 1161 attached to the lower chassis 115, or vice versa. This allows the upper chassis 116 and all attached components to slide laterally over the range 1162 of the servo. In this configuration, the lower chassis may contain little more than the rotor drive motor and the rails or glides that connect it to the upper chassis.

An arrangement as shown in FIG. 11, this arrangement may have the effect of shifting and separating the upper chassis and attached components of the vehicle laterally to one side of the rotor when in motion, resulting in an asymmetric appearance of the device. This may be aesthetically desirable or undesirable depending on the specific "look and feel" desired for the device. For example, if the device is used as a "battle" toy, in some cases the asymmetric appearance may be preferred to match the arrangement of character features, such as those disclosed below. In other configurations, a more symmetric appearance may be desired, in which case other configurations of the offset mass 153 disclosed herein may be used. An arrangement as shown in FIG. 11 also may be desirable for functional purposes, since it increases the weight being moved, so a relatively small offset results in a more significant degree of motion.

Regardless of the specific arrangement and movement mechanism of the mass 153, it may be preferred that the mass is located centrally on the rotational axis of the device when the intent is to keep the vehicle stationary, for example in a "rest" state. The mass then may be moved to one or more sides of the central position to impart varying amounts of lean, and hence varying speeds of motion, in a desired direction. In some embodiments, the mass may be movable in multiple directions in a horizontal plane, such as forward/back and/or left/right, relative to a "front" of the device as previously described. In some embodiments, the mass may be movable only in a single direction such that the device can only be moved in a "forward" direction—in this arrangement, whichever direction corresponds to movement of the mass in the single direction away from the rotational axis. Such limited motion may be acceptable because, as previously disclosed, devices disclosed herein also allow for rotational/yaw control of the device so that the "forward" direction can be repositioned at any angle around the rotational axis of the device.

The mass 153 need not be centered in the "rest" state. For example, in some embodiments it may be desirable for the mass 153 to be offset from the rotational axis to counterbalance the weight of other components that cannot be evenly distributed around the rotational axis, such that the overall center of gravity of the device is located above the tip 102 of the primary rotor. Further, the mass may not be movable at all, but rather may be a fixed offset mass that imparts a permanent imbalance to the device. That is, the "rest" state of the device may be one in which the device, when operating, always moves in a "forward" direction. Movement of the device still may be controlled via the rotational/yaw control previously disclosed, thereby allowing for a full range of horizontal movement. Spinning the device rapidly (via the yaw control) typically will still have the net effect of forcing it to stay relatively still while it rotates, while maintaining any particular yaw orientation for a period of time will lead to a controlled movement in a certain direction as previously disclosed.

Figure 12:
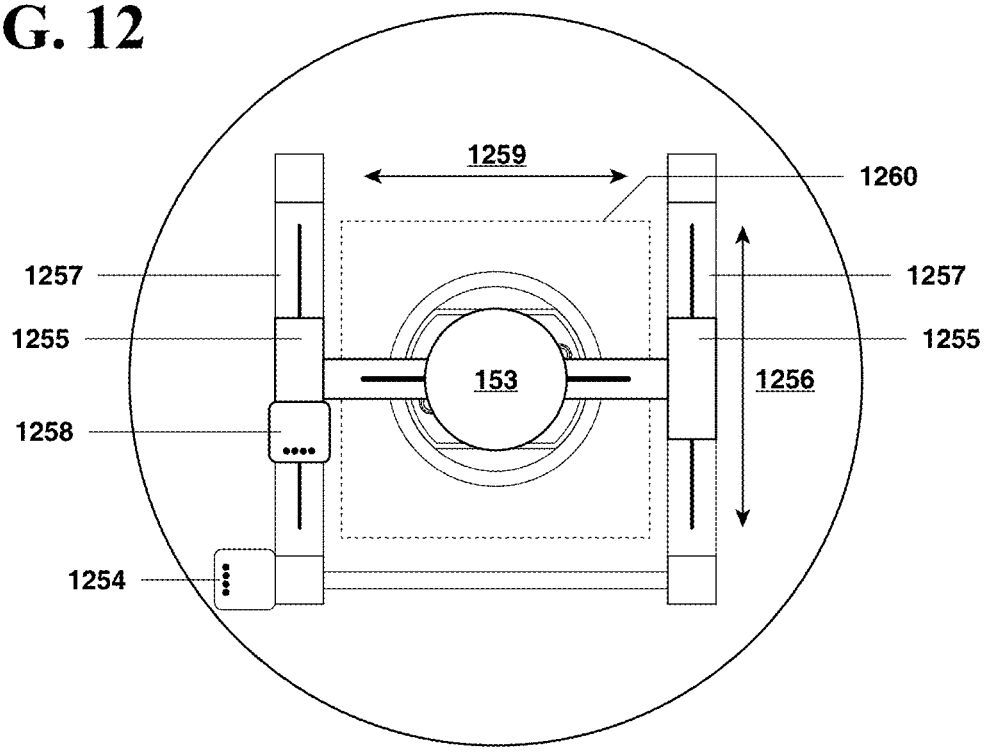
FIG. 12 shows an example of a device as disclosed herein in which a motion-affecting mass is movable in two dimensions.

In an embodiment, the offset mass 153 also may be moved in two dimensions in the horizontal plane. FIG. 12 shows an overhead view of a device as disclosed herein that allows for such movement. In this implementation, a first linear servo 1254 moves two sliders 1255 along a first axis 1256, for example by rotating lead screws contained in the rails 1257. This results in the ability to move the offset mass 153 on a first axis, shown as a vertical axis in the top view of FIG. 12. A second linear servo 1258 moves the offset mass 153 along the axis 1259, for example via a lead screw. As previously disclosed, the servos 1254, 1258 may operate in response to a signal received from a remote control, such as via control signals from a controller 130. This arrangement provides the ability to move the offset mass 153 in two orthogonal dimensions in a horizontal plane, anywhere in the region 1260. This allows the vehicle's rotational z-axis to be leaned in any direction, and as such for motion to be initiated and maintained in any direction, without the need to rotate the chassis of the device as in previously-disclosed arrangements. The operation of this arrangement by the user is analogous to control of a helicopter, which can be steered in 2-dimensions (left-right and forward-back, i.e., within a horizontal plane) or any combination thereof, while being oriented rotationally left and right using a yaw control. Other configurations of actuators may be used to achieve a similar effect, such as two rotary arms connecting to a center point, a combination of one rotary and one linear actuator, or the like.

Regardless of the specific arrangement of the offset mass and associated controlling components and circuitry, the mass 153 may be controlled via an analog signal, such that varying degrees of tilt, resulting in varying speed, can be initiated. Alternatively, a binary, single-position offset may be used, in which the offset mass shifts from a balanced "rest" position to a single offset position, such that the device is either stationary or moving forward at a single speed. Such a configuration may allow for the actuator 1040 or 155 to be a simpler binary actuator.

Figure 13:
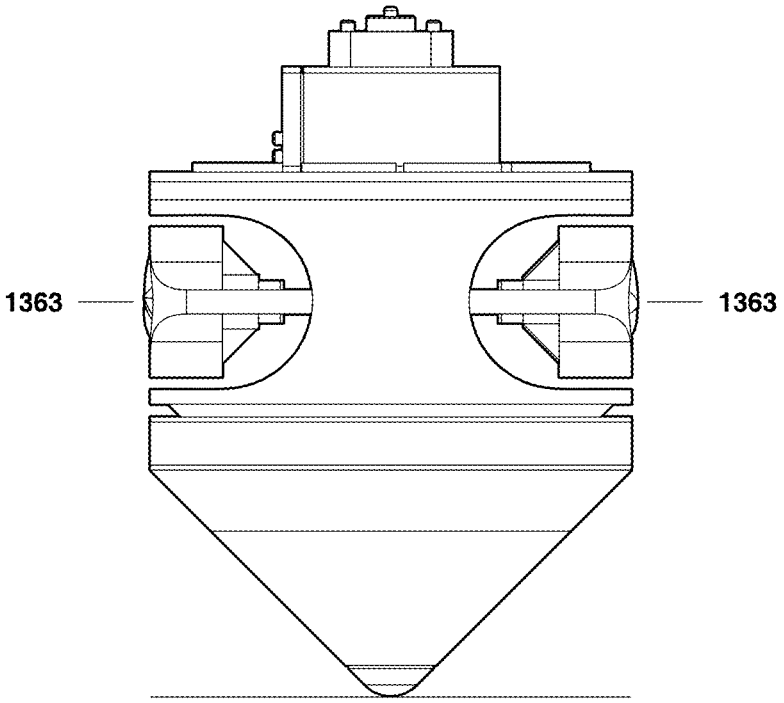
FIG. 13 shows an example of a device as disclosed herein that uses multiple fans to control motion of the device.

In some configurations, horizontal motion of the device may be achieved via mechanisms other than movement of an offset mass 153. For example, rather than shifting the offset mass to cause the device to lean in a direction, one or more fans or propellors may be used. FIG. 13 shows an example of such a device. In this example, two offset fans 1363 are positioned on opposite sides of the chassis, and may be operated in conjunction with one another to trigger a lean of the device. Although this example shows two fans, any number of fans attached at any orientation, typically will result in a controlled steady force on the chassis and a resulting lean when activated. This motion may be combined with the yaw control described in Claim C to give complete control of the vehicle. In contrast to the counter rotor fans described with respect to FIG. 2, it may be desirable for the offset fans 1263 to be arranged to provide a force toward or away from the rotational z-axis of the device rather than tangent to its circumference, so that the majority of the force exerted by the offset fans results in a lean and horizontal movement of the device rather than a change to its rotational speed or direction.

As previously disclosed, the rotor typically rotates at a significant rotational velocity relative to the chassis of the device, which typically maintains the device in an upright position via the gyroscopic effect. It is possible for the device to fall over, for example from an impact or an eventual reduction in the rotor speed, such that gyroscopic forces cannot maintain the device in an upright position. When this occurs, other surfaces of the vehicle (in addition to the rotor tip 102) will contact the play surface, such as the larger conical surface of the rotor body 101, parts of the chassis 115, 116, or an outer housing that typically covers and protects the chassis and all its attached components, as shown and described in further detail below. These surfaces may be moving at significant speed, and contact may result in unpredictable motion of the vehicle along the surface, into obstacles, and the like.

When such an impact or fall occurs, it may be desirable for the drive motor 104 to be de-activated as quickly as possible, to cease any further motion and reduce the chance of damage as these surfaces contact the ground, and to also reduce any chance of injury from the fallen vehicle flicking or rolling into a user's hands, or parts breaking off the device. It also may be desirable to cease any further movement of any fan motor, offset mass servo, or the like, as they will no longer be effective at controlling movement of the device. In addition, LED indicators or sounds may be triggered to clearly indicate to the user that the device has failed, ended its round in a given game, or the like. The device also may be configured to enter a low-power, sleep, or other mode to reduce battery use and wear on the moving components, after a certain amount of time without further input from the user. In an embodiment, an IMU such as IMU 119 may be used to detect that a fall has occurred. A fall or impact may be detected, for example, when the gyroscopic sensor readings of X and/or Y axes (i.e., the horizontal axes) show that these axes are tilted past a certain angle from vertical, for more than a set amount of time. The relevant angle may be selected to represent a lean further than the device could maintain during regular motion, i.e., upright or nearly upright, within the limits available to imbue horizontal movement. Once a fall is detected, the motors and servo may be shut down and a fall, fail, or other condition may be indicated to the user with LEDs, sounds, and/or other indicators.

Figure 14:
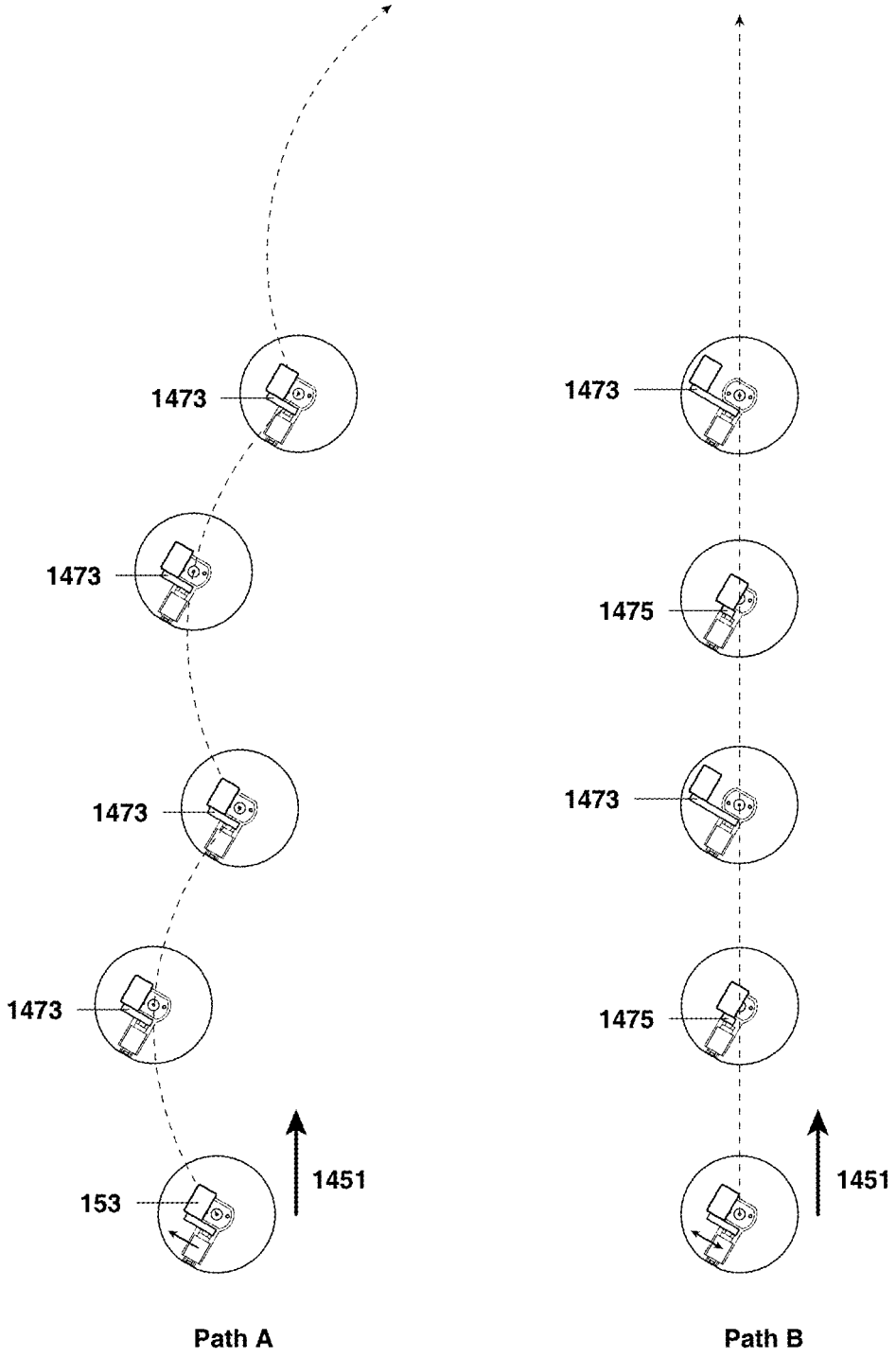

When an offset mass of any form is used to initiate and control forward movement of the device as previously disclosed, the resultant motion is not typically an exact straight-line path. FIG. 14 shows example paths that a device as disclosed herein may follow under various forms of horizontal movement control as disclosed herein. Path A shows the behavior of a device if the offset mass 153 is moved to a fixed offset position 1473 and maintained in that position as the device moves horizontally across the play surface. In this case, the device follows a path made up of a series of arcs. The device moves generally in the intended direction 1451, but deviates from an exact straight-line path as shown. This is because the path results from combined effects of precession and nutation of a regular spinning mass, in this case the rotor 100, and the linear motion that results from the intentional and sustained lean of the vehicle maintained by the offset mass mechanism as previously disclosed. Such a path may be unexpected by the user and, therefore, undesirable in some embodiments.

The magnitude of the offset of the mass 153 may be altered as the vehicle moves to counteract the slight arcs of this motion, thereby resulting in a more straight-line motion. The offset may need to be greater at times when the un-corrected path would be at inflection points 1474, and reduced at points where the un-corrected path would be relatively straight, as at positions 1475. Such control may be provided by the user or, more preferably, via a PID closed-loop control system.

As previously disclosed, such a closed-loop control system may be used to maintain desired rotational states of the device. The same control hardware or a similar control system may be configured to maintain a constant lean in the vehicle, based on gyroscopic data returned from an IMU as previously disclosed, when the user has initiated a straight-line motion. For example, the feedback loop may provide output control over motion of an offset mass 153 to counteract the inherent curved motion while maintaining motion in the direction indicated by the user controls. Similarly, if the user initiates some degree of turn as they move forward (or backwards), the PID control system may adjust the offset mass to ensure a smooth curved path, dampening or entirely cancelling any unintended perturbations in path. The PID system hardware and/or software may be the same as previously disclosed in relation to maintaining the device's position and orientation generally, such as for yaw control, or it may be a separate combination of hardware and/or software operating on, or in conjunction with, the device.

In some horizontal motion paths, particularly those involving more extreme levels of lean of the device, more significant speed, impacts, or sharp and fast turns, the device may fall into a circular or spiral path that is caused and dominated by the precession effect of a spinning mass. In such cases, the precession effect may overwhelm the explicit control of the vehicle device determined by the user and their control of both the offset distance and rotational position of the offset mass 153. In such a situation, the device typically will not fall over immediately, but it may require a specific path of motion by the offset mass 153 to return the vehicle to a more vertical orientation, desired path, or a completely stationary, absolutely vertical position from which user-controlled motion can proceed. Although such correctional motion may be achieved by a user via the remote control directly, doing so may require significant skill and practice, typically of both the yaw rotation control and of the magnitude of offset of the offset mass 153. Accordingly, it also may be useful for a closed-loop control system to be configured to assist in returning the vehicle to a near-stationary, near-vertical orientation. The control system may be the same as one or both of those previously disclosed, or it may be a separate combination of hardware and/or software operating on, or in conjunction with, the device.

For example, the device may be configured with a "hands off" mode, such that when no user input is received for a period of time, or the remote control device detects that the user has ceased providing input, the integrated PID closed loop control function may manipulate both the yaw rotation and offset mass position, so as to cause the gyroscopic lean in every horizontal direction back to zero as quickly as possible. Such a configuration may act as a "failsafe" if the user feels that they are losing control of the device, or the device appears to be in an undesirable movement state. In that case, the user may simply release the controls of the remote control, stop making adjustments via the remote control, or activate a specific control to engage the "hands off" mode, and the vehicle will act to still itself to perfect vertical and stationary position as quickly as possible. It has been found that PID control is very quick, accurate, and reliable at performing this function, typically more so than even a skilled user doing so manually.

FIG. 15 shows a specific example of such a motion, which may be implemented by a closed-loop control system as disclosed herein. In FIG. 15A, Path A, from a stationary start position, offset mass 153 is moved suddenly to an extreme offset position 1593, intending to initiate motion in direction 1594. The speed and magnitude of the change is such that it triggers a strong precession spiraling path 1595 by the rotor acting as a spinning top. This strong precession and associated lean is such that the usual yaw stabilization mechanism, which normally would maintain the chassis facing in the same orientation, is overwhelmed. As a result, the entire chassis rotates along the precession path 1574 and the spiral or circular precession path continues at 1596. In this example, the spinning top nature of the device and its inherent precession effect outweighs the controllable aspects of the yaw and offset mass control mechanisms. This is undesirable and unexpected to the user, as it overcomes their predictable control of the vehicle.

Path B in FIG. 15B shows an example in which the closed-loop control system adjusts movement of the device. From the same starting position, with the same offset mass motion 1599, the same action is initiated and the same strong precession spiral path 1595, 1596 results. In this case, PID closed loop control is enabled to return the device to a stationary position when the "hands off" user input state, or lack of user input, is detected. At point 1597, the user indicates a "hands off" mode, for example by releasing their input to a trigger or wheel control of a remote control device as disclosed herein, by releasing any control in a mobile app, gesture, or other user input, and the PID closed loop system engages to still the vehicle as rapidly as possible. The PID control immediately moves the chassis rotation (yaw) and offset mass offset 1598, 1599, to re-balance and still the device promptly. This returns the device to a stationary position 1590 from which the user can commence control and move again in any direction easily. As a specific example, in this illustration the offset mass is positioned on the "lowest" side of the device, such as on the left side of the device at 1598, then rotate the mass CCW at a reducing offset as the device straightens. More generally, the PID may perform such actions or any similar actions required to return the device to the stable, rotating "sleep" or "rest" state.

As previously disclosed, in some cases a device as disclosed herein may fall or collide with another object, either intentionally as part of a battle game or unintentionally. In some cases, the user may desire to pick up the device after such a fall or collision, for example by an outer housing as disclosed herein. It may be desirable for the vehicle to enter a "launch" state or startup sequence in this case, for example whenever the rotor 100 is not touching a horizontal play surface, when the IMU 119 detects that the user has forcibly stopped rotation of the rotor, or the like. In such a situation, it may be desirable for an IMU, which may be the IMU 119 or a separate component, to detect that the user has picked up the vehicle and is holding it near-vertical, for sufficient time to indicate they're trying to commence a launch of the vehicle. For example, the device may be configured to enter the launch state when the IMU and/or controller detect that the device has been held away from a horizontal play area for at least 1 second or other set period of time. This may be detected from available IMU data when both X and Y axes are within a reasonable angle of vertical, for example, within 10 degrees of vertical. Such detection may remove the need for the user to explicitly trigger a launch of the device, such as via a button or other interface, though an explicit launch also may be available as a backup or alternative launch trigger.

Once a user intention to launch the device is detected, a launch process may begin by activating the rotor drive motor 104. Other components, such as a centrifugal fan 128 or other counter rotor mechanism, may be held still because there is no need to balance any counterrotation while the device is held steady by the user). Similarly, any servo(s) used to control an offset mass 153 as disclosed herein may be centered, thereby placing the device in its most balanced state, ready for launch.

Other techniques and devices may be used to determine that the device has been picked up by the user, alternatively or in addition to detection based on IMU data. For example, a switch may be used to detect the pull of gravity of the hanging parts of the vehicle, once the user is holding the vehicle. Such as switch may be that be mechanical, optical, or magnetic, or the like. The switch may detect, for example, the chassis and connected components "hanging" below the outer housing when the device is picked up, and/or it may detect the rotor or its connected motor are hanging below the chassis. In both cases, the relatively heavy components of the device such as the rotor and/or the chassis will hang down below the components held in the hand above when the user lifts the device by its outer housing. The hanging effect can be detected by an appropriate switch in contrast to the opposite situation in which the device is not held by the user and the weight of all components passes down through the rotor, and the entire weight is supported from the rotor and its tip resting on the play surface.

In some cases, users may want to store devices as disclosed herein in a vertical position, as the aesthetically most pleasing storage orientation, typically in a stand designed for such display. However, detecting a 'near vertical' orientation from the gyroscopic sensors of the IMU, may not allow the device to detect the difference between the device standing vertically in a stand and the device being held near vertical by the user, which likely would occur when the user first lifts the device from the stand and wants to launch it. To address this, the controller may be configured to detect a threshold degree of ongoing variability in one or more of the gyroscope values, and/or a certain level of variability in one or more of the accelerometer values, and when such variation continues over a threshold amount of time. This variability in orientation results from unavoidable slight movements of a user's hand, arm and body of a person when holding the device, compared to the absence of (non-trivial) motion when the device is placed in a stand on a fixed surface for storage. By monitoring the IMU data for such variations, pick-up of the device may be detected even if the device is picked up from an already-vertical position such as on a stand. The launch sequence thus may be initiated appropriately, as the user would intuitively expect when picking up the device. This arrangement allows for the device to turn on "automatically" when picked up by a user, but also may be combined with an explicit on/off electrical switch as may be expected for such a device.

Once a launch sequence as described above is commenced, a certain minimum speed of the rotor 100 is required to ensure the rotor provides sufficient gyroscopic stability to keep the device vertical. With sufficient speed in the rotor, launching is a simple matter of placing the device on a horizontal play surface at a near vertical orientation. A suitably high rotation speed may be reached or determined by, for example, waiting a pre-determined amount of time for the motor to "spin up" the rotor to a pre-determined set speed, for example at a given power level. The power applied to the rotor typically is a function of the voltage applied to the motor, in some cases with a pulse-width-modulated (PWM) duty cycle determining how hard the motor is being driven). Alternatively or in addition, the motor speed and/or rotor speed may be measured directly, for example using optical, magnetic (hall effect), and/or mechanical encoders or counters, or detection and frequency measurement from back-EMF.

In some embodiments, the device may indicate to the user when it has reached a sufficient rotational speed to be "launch ready," for example using any combination of light (such as LEDs), sound, vibration, or the like.

Other functionality may be implemented in the device based on direct user control of the device, i.e., separately from a remote control as disclosed herein. For example, during operation of the device, it may be presumed that the user wants to begin another launch sequence after picking up the device, whether from a display stand (to begin a new play session), or after ending one play session and to begin another. In some cases, the device may include an interface for the user to intentionally power off the device. The interface may be a button, switch, or the like, or the device may detect various movements of the device by the user that will trigger pre-programmed behavior. For example, the user may shake the device to indicate that the device should switch off, i.e., enter a low-power or zero power mode, so that it can be replaced in a stand or otherwise put-down, switched off. Shaking motion may be detected based on a threshold acceleration reading obtained from an IMU as disclosed herein.

As previously disclosed, devices described herein may be controlled by way of a wireless remote control operated by a user of the device, similar to the use of other remote control (RC) toys and hobbies such as RC cars, boats, drones, helicopters, and the like. A wireless remote control system is preferred, to avoid a control cable interfering with the rotational and tilt motions of the device. The remote control may use Bluetooth, WiFi, radio, optical or infrared, audio (whether audible or inaudible to the human ear), visual gestures detected by a camera on the device, control via a smartphone app or the like, voice control, or any other suitable mechanism. Control signals may be provided directly to the device, such as in the case of physical gestures or control via a smartphone app, or they may be provided via a dedicated hardware remote such as those used for conventional RC vehicles.

In some embodiments, a preferred remote control device may be provided with the controllable device as disclosed herein. FIGS. 16A-16B show side and perspective views of an example of such a device, respectively. The design incorporates a gun- or handle-style grip 1665 as its base, which houses required electronic components and provides a primary ergonomic component held with a gun grip by the user in their preferred hand. The design may be symmetric around the controls so that it is equally usable in the left or right hand of the user. Attached to the grip 1665 is a trigger 1666, that can be pulled to initiate forward motion of the vehicle, and/or pushed with the front edge of the forefinger to initiate reverse motion (in embodiments that allow for more than one direction of movement initiated by the user). These actions result in a corresponding swing of offset mass 153 as previously disclosed. The degree of offset of the mass may be proportional to the amount of force or displacement applied to the trigger 166 when analog controls are used as previously disclosed. In some embodiments, the trigger may only accommodate a forward, squeeze action, and may be made more compact by not requiring the top trigger edge (as required for the push action). With such a control, the device can only move forward, but this may be only a minor limitation because the device can be rotated 180 degrees, or indeed to any rotational orientation, using the yaw control mechanisms as previously disclosed herein. Although similar in appearance to the trigger-style controls used in existing RC car remote controls, and therefore intuitive to many users, the operation may be even more intuitive due to the new physical arrangement introduced by the particular form factor shown in FIG. 16A-16B. This is, in part, due to the horizontal or near-horizontal orientation of the wheel 1669, in contrast to the vertical orientation of a conventional RC devce, which allows movement of the control component to be translated directly into similar motion of the controlled device. That is, rotating the wheel 1669 CW or CCW results in a corresponding CW/CCW motion of the device. Further, the back edge of the wheel 1672 may allow a more experienced user to control the yaw of the wheel with the raised thumb of their trigger hand, while their remaining fingers hold the grip and forefinger squeezes the trigger. In this manner the user may control the device one-handed, which is a unique benefit of this configuration.

The remote control may include a wheel 1669 mounted horizontally or near-horizontal on the top of the grip 1665. The wheel typically is manipulated by the users'other (off) hand, to control yaw rotation of the vehicle, as previously disclosed. For example, in one control scheme, a clockwise twist of the wheel results in a proportional, corresponding clockwise rotation of the vehicle's chassis and/or the attached housing. Upon release of the wheel, the wheel returns to its default rotational position and the associated rotation of the vehicle's chassis will cease, though in some embodiments the device may have a constant steady-state rotation, as previously disclosed. Similarly, turning the wheel 1669 counter-clockwise results in counter-clockwise rotation of the chassis and/or housing. In an embodiment, the further the wheel is twisted from its default position, the more rapidly the chassis and/or housing rotates, thus control is proportional.

In an alternative embodiment, the wheel 1669 may be free to rotate without restraint in either direction, rather than being spring-loaded to a default centered position. In such a configuration, yaw rotation of the chassis maps directly to the rotation of the remote control wheel 1669, so users directly control the yaw position and rotation by moving the wheel a set amount, or spinning it at a certain rate to initiate an ongoing spin of the chassis or housing. Typically some amount of additional weight is intentionally included in the wheel so it can be spun at different rates and will maintain its momentum.

The unique vehicle-type device and accompanying user control system disclosed herein provide a novel user experience as a stand-alone toy when used alone, similar to other remote controlled toys and other novelty devices. Additionally, devices disclosed herein may provide an exceptionally well-suited format for multi-user games and competitions, where two or more users control their devices as vehicles, characters, or the like, on the same play surface. In particular, the spinning top format is ideal for various battle games, where the users intentionally drive their vehicle into their opponents, in a way that can be clearly detected and recorded as a successful impact/strike.

In an embodiment, an internal IMU such as the IMU 119 previously disclosed may be used to detect impacts. For example, a 3-axis accelerometer in an IMU can detect both the amplitude and direction of an impact and watch for such impacts in a range that would be expected when two vehicles collide. Detection of such an impact alone may provide the basis for various games played using devices as disclosed herein. For example, a visual, audio, and/or haptic indicator may signal to a user that their device has been impacted by, or has impacted, another user's device.

The game system may be given additional dimension by including components and features that allow for a determination of whether an impact represents an intentional attack by the vehicle on which the impact is detected, or instead represents receiving an impact caused by another vehicle attacking the one at which the impact was detected. In both cases, the vehicle may detect an impact, i.e. a sudden acceleration or deceleration detected by one or more axes of the accelerometer. In an embodiment, each device may compare the direction of travel of the vehicle, with the direction of acceleration/deceleration impact that is detected, to determine whether the vehicle initiated, or received, an attack. For example, a simple rule may be applied that if a vehicle moving forward strikes another vehicle 'front on', i.e. at a point on or close to the front-side of the vehicle (as previously defined), and the vehicle is decelerated by that impact, that vehicle can be considered to have successfully made a strike on another vehicle. Conversely, if a vehicle detects an impact, but it is either not moving significantly, or is moving in a direction such that the impact clearly wasn't from the vehicle's direction of motion, then that vehicle may be considered to have been attacked and/or to have "suffered damage" from an opponent.

Figure 17:
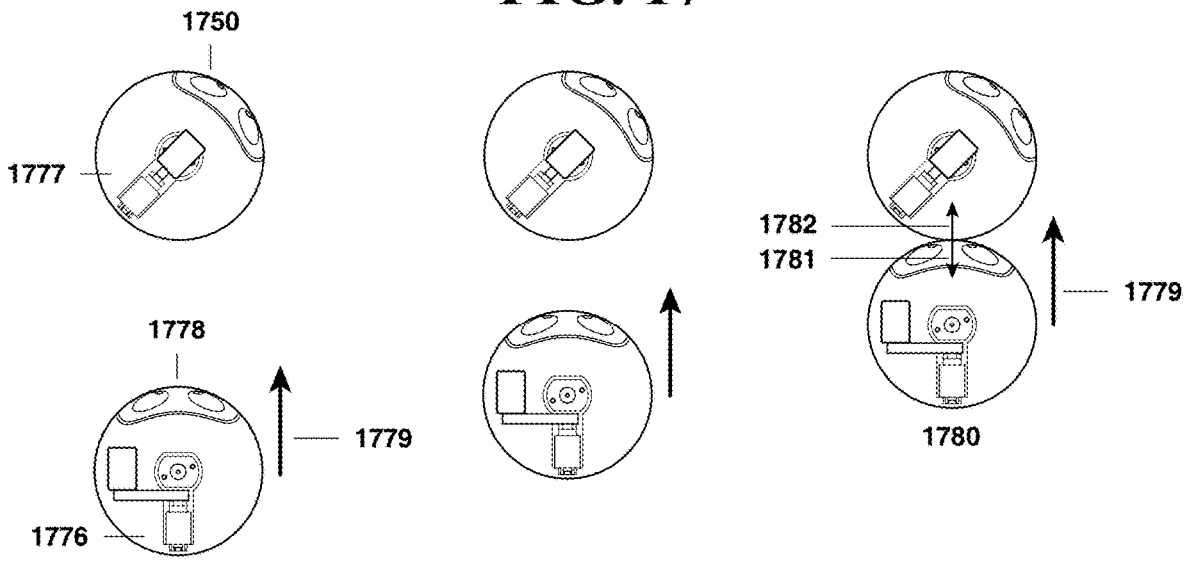
FIG. 17 shows an example of an impact between two vehicle devices as disclosed herein.

FIG. 17 shows an example of an impact between two vehicle devices as disclosed herein. The view is shown from above the play area, i.e., above the devices, with the offset mass shown similarly to FIGS. 14-15. In this example, a first vehicle 1776 is moving in direction 1779 to attack the second vehicle 1777 which is stationary. The "front" of each vehicle is indicated by the "eyes" 1750 attached to the front side of each, which indicated that the attacking vehicle 1776 is moving towards the second vehicle facing forward, while the second vehicle is facing diagonally away from the attack.

When the attacking vehicle impacts the second vehicle, as shown at 1780, the first, attacking, vehicle experiences a sudden impact, specifically an abrupt deceleration in the direction indicated by arrow 1781. If the direction of that deceleration is within a threshold angular distance, such as 5 degrees or less, of the reverse of the direction of travel indicated by 1779, it can be considered a successful "attack" by the attacking vehicle. In some embodiments, a "severity" of the attack may be determined based on the magnitude of the deceleration experienced. Considering the acceleration experienced by the attacked vehicle 1777, it experiences a similar magnitude of acceleration, but in a direction that is not within a few degrees of its direction of travel. Similarly, if the vehicle 1777 is not moving, or not moving at a sufficient rate to be considered "attacking," it may be determined to have been attacked by the attacking vehicle. As such, the impact would be recorded as taking a hit or blow from an opponent, which again may have a particular severity level.

Once detected, a vehicle that has made a successful attack may indicate as much with any suitable user indicator, such as visual, audible, haptic or any other alert. For example, each device may include one or more LEDs or other light displays and/or audible alerts via a built-in speaker. As another example, the device may potentially pass the record of a successful attack back to a smartphone app, remote control device, or other device for recording and scoring. For example, a remote control as shown in FIG. 16 may include various feedback indicators to alert the user of successful attacks, damage level, remaining "health," and the like. A successful attack may also allow the vehicle and user to earn some specific functional benefit during a game, such as a raise in their "health" level, a special attack or defense function, or the like.

A vehicle that detects that it has received damage also may indicate as much with a suitable visual, audible, or haptic indicator, and may pass the record of that damage received back to another device. For example, when a vehicle receives "damage" due to a successful attack by another vehicle as previously disclosed, the damaged vehicle's reduced health may be indicated by one or more color-coded "health level" LEDs, as is common in computer games, which may be visible to all players such as, for example, green/yellow/red for decreasing health status or increasing damage. Extreme low health may be indicated by a flashing health indicator LED(s) or particular sounds.

In an embodiment, the behavior of the device may be intentionally degraded due to such "damage," though it is expected that generally no actual physical damage will be suffered by an attacked device. For example, through appropriate electronic and software control, the performance of the virtually damaged vehicle may be degraded by reducing the speed of its rotor, limiting the amount of control available to the user, such as reducing the speed or degree of rotation available, or the like. A reduction in rotor speed progressively decreases the stability of the vehicle, making it slower to move, and more susceptible to a significant offset/tilt when impacted again by an opponent. As another example, the range of amplitude of the offset mass may be partially reduced to give a noticeable degradation in motion and controllability for the "damaged" vehicle. In an embodiment, after taking a set number of blows/hits from an opponent or a total amount of damage where the severity of a successful attack is tracked, a user's vehicle may be so weakened, and its rotor sufficiently slowed, that it is only just able to maintain stable upright orientation. In this "close to defeat" state, a final impact from an attacker may virtually "kill" or "destroy" the vehicle by completely knocking it over, which can be detected as previously disclosed. In this situation, any suitable indicators may signal the defeat of that vehicle, and the user may be required to manually pick-up the vehicle to reset play, restarting the launch sequence, to re-join the battle game.

Various techniques may be used to distinguish between an attacking vehicle impacting an opponent vehicle, and impact by the attacking vehicle with a stationary obstacle or the periphery of the play area. For example, a successful attack may be indicated by LED, sound, vibration, or the like as previously disclosed, but may not count to any actual recorded score or explicit benefit (such as no health gained or points earned). All actual scoring in that case may result only from received damage as detected by the "attacked" vehicle, so no incentive exists to impact a non-opponent object. Such an arrangement may be preferred in embodiments in which vehicle devices communicate with one another or with other remote devices, thereby allowing for confirmation of a successful attack between attacking and attacked vehicles. As another example, if the play area boundary is physically limited by a low barrier, close to the play surface, impact with the boundary will occur at or close to the rotor tip, and the resultant deceleration of the chassis may have a detectably different acceleration profile than impact with a similarly weighted second vehicle. For instance, the fact that the impact occurs near the rotor tip may result in a tilt at the point of impact, more than impact at a mid-point height on the housing or body of the vehicle. Similarly, an impact with a similar-weight opponent may result in less acceleration than an impact with a relatively fixed/solid barrier.

As previously disclosed, vehicle devices and associated remote control devices as disclosed herein may include one or more user indicators, such as LEDs, audible indicators, vibration or other haptics, or the like. Such indicators may be used to convey a range of information to operators of the devices. For example, indicators or patterns of indicators may provide feedback for key events, such as beginning a match, "defeat" of the device or an opponent, "victory," surviving a certain amount of time in a single match or multiple matches, or the like. As another example, the indicators may provide information about the electronically and/or mechanically degraded performance as previously disclosed. For example, a series of LEDs may light up through green, yellow, or red to indicate various functionality that has been degraded due to impacts by other devices.

In an embodiment, devices in sufficiently close proximity, or which have been indicated to be competing in a common game by their operators, may exchange data with one another either directly or via a remote device such as a smartphone or table, remote control, or the like. Such connection may be used to provide further game functionality, such as connected, automated scoring of games, storing of results, awarding prizes or leader boards, and the like.

Figure 18:
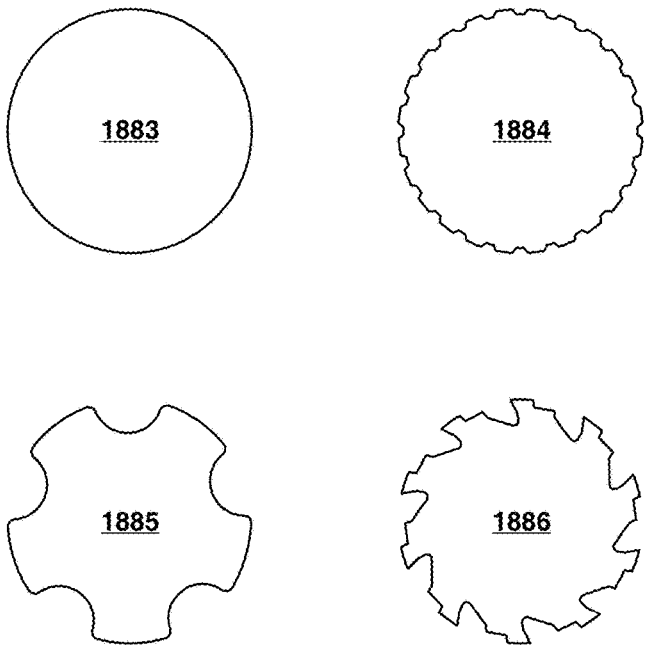
FIG. 18 shows examples of physical modifications or alternate device arrangements that may be used according to embodiments disclosed herein.

Alternatively or in addition to the previously disclosed game features, physical alterations to the devices may provide additional options for battle games. For example, the shape of the contact parts of the vehicle device may be altered to result in more or less violent, random deflections when two vehicles contact each other. FIG. 18 shows examples of physical modifications or alternate device arrangements that may be used. If the outer rim of the rotors 103 are kept as a smooth, cylindrical surface, as shown top-down in 1883, two vehicles will have minimal deflection effect when they impact. Typically such devices will gently bump against one another and bounce slightly away, but little or no tangential deflection or tilting effect will occur on either vehicle. If moving slowly, the vehicles may end up simply rubbing against one another until one vehicle explicitly moves away by its own controlled motion. However, if slight texture, scallops or protrusions are added to the rotor surface as in 1884, and the rotors are allowed to impact (i.e. they are the widest circumference part of the vehicle), then impacts will typically make more noise, resulting in movement away from the other device and/or deflection in a random angle from the path of motion, and potential unexpected tilt/lean, from which the vehicles may take time or skill to recover to stable motion. More aggressive shapes, such as those shown at 1885 or 1886, with sizeable gaps or large protruding shapes, particularly acute/sharp shapes, will result in more extreme and unpredictable deflections, knock back, and impact sounds when vehicles collide. In an embodiment, the rotor rim may be made from, or incorporate, a material intentionally selected to generate sparks on impact with the same style rotor on another vehicle. This would create a dramatic, spinning, 'flying sparks' effect when vehicles collide.

It may be preferred that the material be flame resistant. Sufficiently hard metals, such as iron powder, when made highly abrasive, or adhered together from filings, may cause sparking as it impacts and heats suddenly from that abrasive impact, and may detach from the rotor. For more dramatic effect, combustible materials such as those used in conventional sparklers (magnesium, sulphur, potassium nitrate, barium nitrate, and the like) may be used. In some embodiments, the rotor trim 103 may be replaceable with different materials to allow for different effects.

Figure 19:
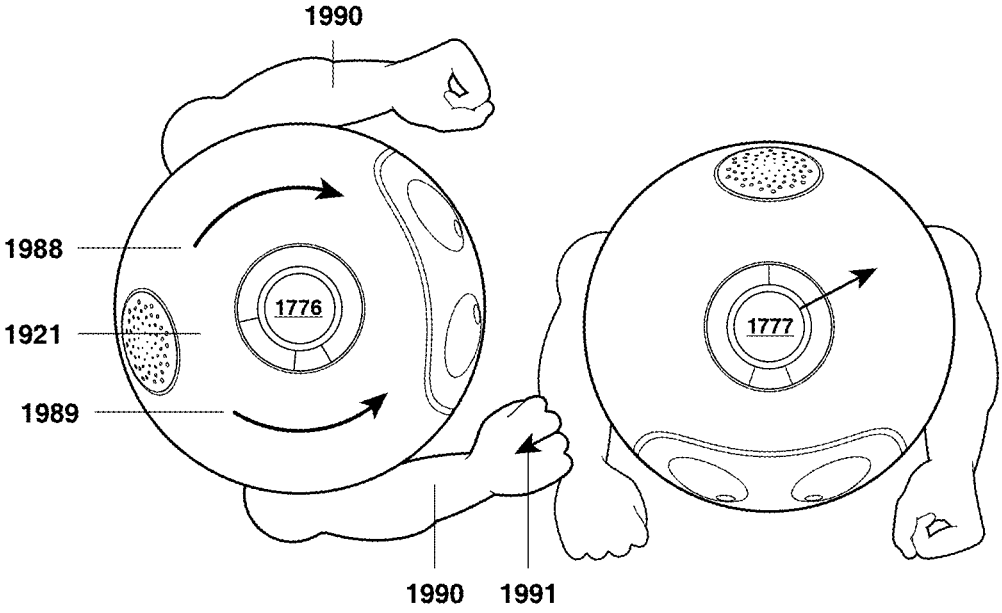
FIG. 19 shows an example impact of two devices as disclosed herein, with outer housings in the form of battling characters as viewed from above.
Figure 20:
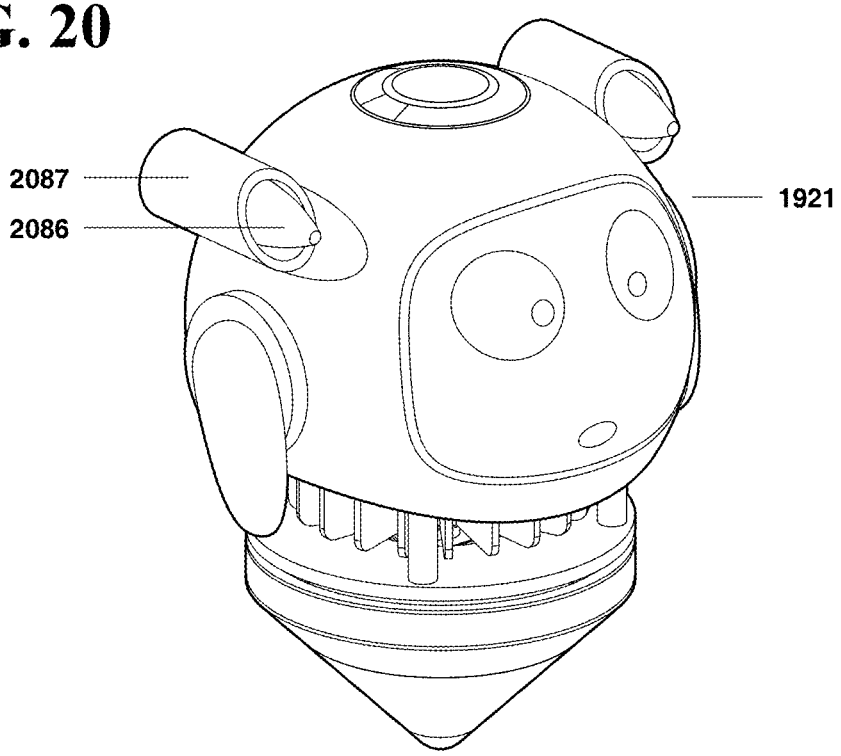
FIG. 20 shows a device viewed in perspective with an outer housing in place as disclosed herein.

In an embodiment, a device as disclosed herein may include an outer housing that covers the components previously disclosed. The housing may be, for example, in the shape of a character, vehicle, or the like, or a simple geometric shape. FIGS. 19 and 20 show example devices with an outer housing in place, which may include additional features for use in a battle game as disclosed herein. FIG. 19 shows an example of two devices with outer housings in the form of battling characters as viewed from above. FIG. 20 shows a device viewed in perspective with an outer housing in place. Various features may be included as part of the housing. For example, fixed protruding contact weapons may be disposed on the housing 1921, such as an arms-with-fists arrangement 1990 or the like. It may be preferred for any such "weapons" or other features to be rigidly attached to the housing 1921, or simply a protruding element of that part. Any size and shape protrusions or other features may be used, which may be designed to match the design of a character concept of the housing. Such features may be wielded as "weapons" of the device via the rotational and horizontal movement control as previously disclosed.

For example, due to the high degree of rotational control of the device as disclosed herein, it is possible for a user to initiate either small "punch" actions by rotating clockwise 1988 or counterclockwise 1989, or alternatively to spin the entire head and chassis rapidly in either direction as a defense against an attacking vehicle moving towards them.

Alternatively or in addition, such weapons or limbs may be connected to the housing via any form of magnetic or mechanical clip, such that sufficient impact can dislodge the weapon, leading to both the loss of that weapon for the remainder of the combat round, and potential slight imbalance of the vehicle, impairing easy control, for the remainder of the round. Dislodged components may be easily re-attached by the user once a round is finished, simply by clicking into place. Such impacts and loss of components also may be detected, such as via the techniques previously disclosed with respect to an "attacking" device, sensors associated with the components, or the like, and apportion a reward or damage based on the impact detected may be awarded. In this scenario, it is not meaningful to compare the impact acceleration to the direction of motion of the vehicle moving on the play surface, as the vehicles may not be moving (or not moving significantly), but may be rotating. In the example shown in FIG. 19, the attacking vehicle 1776 is rotating anti-clockwise 1989 so its weapon 1990 contacts the opponent 1777. Upon impact, an acceleration 1991 may be detected as both an acceleration/impact, and as a sudden decrease in the gyroscopically measurable counterclockwise rotation of the chassis. Or in rotational terms, the attacking vehicle 1776 may be rotating in counterclockwise direction 1989 at the point of impact, and would experience a sudden reduction or reversal in that rotation, in direction 1988. Such a data profile detected by the IMU may be detected as a successful rotational 'punch' or other attack.

In contrast, the attacked opponent vehicle 1778 is not rotating or moving in this example, and experiences an impact acceleration as indicated by 1777. As the vehicle is neither rotating or moving, it can't be considered to have successfully "attacked" another vehicle/opponent. However, the same impact may be recorded as the vehicle receiving damage, with similar effects as described above.

Alternatively or in addition to fixed features on the device housing 1921, the housing of the vehicle may include attached, but moving devices such as launchable "weapons," which may be controlled by any suitable servo, motor or other electronically triggered actuator. Examples of such components include arms or pistons that "punch" forward from the device, weapons that swing in an arc from above or the sides, or the like. FIG. 20 shows a specific example device that includes one or more "missile launchers" 2087, containing one or more projectiles 2086. The projectiles 2086 may be launched via an actuator that controls a spring-loaded or pneumatically-driven chamber, and may be formed from relatively blunt or softened plastic, rubber, foam, or the like, and launched at relatively slow speeds to ensure they couldn't harm a real user. Launching of the projectiles may be triggered by any suitable user input, such as a dedicated control on the remote control, gesture or voice activation, activation via a smartphone/tablet app, or the like.

Successful strikes of a projectile on opponents may be scored manually by the users (i.e. they visually must watch to see if the projectile hits the target) or may be detected by the minor accelerometer spikes caused when a vehicle is struck. Given the weight, speed, and tip hardness of the projectiles, impact by these projectiles is typically detectable as distinct from the heavier/larger impact of hitting an opponent vehicle or fixed barrier. By watching for an appropriate impact signature, it is possible to detect a projectile impact, and score damage to the vehicle appropriately. Such actions give a more intentional, dramatic, fun aspect to battle, and a more severe impact on the opponent that likely leads to at least temporary disturbance to their position or control, potentially putting them at higher risk of battle game defeat.

The outer housing 1921 may attach to the chassis 110, thereby covering and protecting the chassis and all the attached mechanical and electrical components. The housing may be designed to represent a recognizable character, such as a caricature of a person, an animal, a cartoon, a stylized robot or alien, or the like. In addition to the novelty, aesthetic, and personalization benefits of the outer housing, the housing also protects the encased electronic and mechanical components from dust, dirt, moisture, spills, and the like, especially in embodiments where the device is intended to impact other devices during play as disclosed herein. It also may protect the encased components from impacts with fixed obstacles, falls onto the play surface or floor, or the like. The housing also may serve to distinguish vehicles from one another when used in a battle or other multi-player game scenario.

The connection between the outer housing 1921 and the chassis 110 may allow for easy removal, attachment, and interchanging of heads/shells without tools, either as a twist lock, friction fit, snap fit, screw fitting, magnetic attachment, or the like.

In some embodiments, different housings may be provided with different "sound packs" or other indicator customizations that match a given character, with sound effects, voice/audio snippets that sound on key actions of the vehicle, or the like. For example, the sounds that are produced by the vehicle when it is switched on, when it begins its launch sequence, when it is ready to launch, when it is damaged in a battle game, when it takes damage in battle, when it is defeated in battle, and the like all may be customized to match the character depicted by the outer housing. The audio may be provided in digital or other software form, and may be obtained by an owner of a device based on a unique ID provided as a number/word ID in the pack provided with the outer housing, which may be provided separately from the base device, or via a QR or barcode. For example, a user may download the associated sound pack via a mobile device and load it to the vehicle via Bluetooth other remote electronic format, or via a direct physical connection. Alternatively, the unique code/ID identifying the appropriate sound pack could be encoded and embedded in electronic form in the head shell, and passed via an electronic connection when that head shell is connected to the vehicle. Custom audio also may be embedded and stored in any form of electronic memory in the outer housing itself, and automatically used when that housing is connected to the device. An appropriate electronic connection may be provided between the outer housing and the electronic systems of the device as previously disclosed, to retrieve that audio data when the housing is connected. The housing also may include both the digital audio data and an audio speaker, so the electronic connection only indicates which audio file to play for a particular play/activity event.

Although described above with respect to multiple human participants, in some embodiments a user may prefer to engage in a practice match, or to use the device(s) when no other player is available. Various arrangements may be used to meet such a need. For example, a fixed-position sparring partner "dummy" opponent device may be used. Such a device may be similar in size to a device and may be placed on the play surface, with room for the user and their moving vehicle to move around and attack from various sides. For example, the dummy device may use any suitable indicator as previously disclosed to alert the user when it has been successfully hit or damaged by the user's attacking device, such as by using a similar IMU sensor as previously disclosed. Alternatively or in addition, the dummy opponent device may include mechanical or optical switches on panels of its surface, to detect physically when a section of the surface is struck by the user's device. A dummy opponent vehicle also may include one or more LEDs or other indicators on certain surfaces/faces or points, which may be illuminated in a set sequence or randomly, as sequential or random targets that the user is requested to strike with their vehicle device, and then 'score' the user on their ability to move to and strike that surface in a set amount of time. The dummy opponent device also may be mobile and/or autonomously controlled, such as by predetermined and/or randomized control movements. The device may include similar or identical mechanical properties to a regular vehicle, but entirely controlled by software, and may include artificial intelligence (AI) assistance of any suitable type.

For example, an opponent may use optical, radio, radar/lidar, and/or audio sensors or the like to locate the position of one or more user-controlled vehicle devices in a play area. The device also may detect the play area's boundary in a similar fashion or based on predefined attributes of play area boundary markers. Based on the data, the autonomous device may be configured to compete with, and attack, any real user vehicles as would a real user controlling a vehicle in a battle. The autonomous device may include a configurable variable level of capability, to suit users of varying abilities. It also may be configured to play collaboratively, attacking only vehicles marked as opponents, but supporting/teaming with vehicles marked as its team-mates. For example, various vehicle devices may be distinguished by a unique optical or visual marking, unique radio signature, computer-readable insignia such as bar codes or QR codes, or the like.

In an embodiment, when two human users wish to compete in a battle game, but are not in a common location, remote communication devices and techniques may be used to connect the two users'devices and allow for remote fighting. For example, a conventional videoconference may be used, with a video camera providing a remote view of the entire play surface. In addition, software executing on the devices or in conjunction with the devices may transmit the users'controlling signal for their vehicle to a remote play location, and vice-versa, thereby allowing the user to control their vehicle remotely.

As suggested above, it may be desirable to keep vehicle devices within a clearly-defined play surface area, even if that play surface is an existing part of a room, outdoor space, or piece of furniture. Limiting the play area means that users can remain seated or standing in a spot where they can view the entire game without moving, and a restricted area can help avoid hazards to the vehicle, like dropping off a table, or falling on to or into a surface that isn't sufficiently smooth for them to operate (e.g. a hard floor that adjoins a carpeted area where a vehicle of this form couldn't operate). It also may be desirable for battle and other multi-player games to restrict the devices in a relatively confined space, so they are more likely to strike one another.

In an embodiment, the rotor tip 102 of the vehicle may be sufficiently small that it is incapable of passing over relatively small obstacles and may require a relatively smooth surface on which to move. As a result, a fixed barrier with any clear edge, as little as a few millimeters in height, is sufficient to contain and stop it. Contacting such a barrier typically does not damage the rotor tip or the device generally, or cause the device to fall over or lose significant stability. Instead, the vehicle simply contacts the barrier and stays within the boundary, or may slightly rebound from the barrier if moving at a higher speed.

A suitable boundary may be made of multiple parts that lock to each other in a chain with a pivot point where they connect. The pivot point where such barrier pieces connect may have sufficient friction to keep the joins relatively fixed, or a set range of positions in which they lock, such that the overall barrier can be easily manipulated into a range of shapes, e.g. circles/ovals, squares, or rectangles. The simple articulated pivot between each piece allows the barrier to be easily folded or disassembled for shipping or storage. The barrier may be made from plastic, bur any suitably rigid materials may be used. The barrier also may be made from, or incorporate, flexible pipe, tube, fabric or other soft/flexible materials, with a simple way to clip or slide sections together to form larger/smaller arenas, and to disassemble for storage. Barriers may also include some form of weight intentionally attached to, or embedded within them, to keep them still even on impact by a vehicle, or adhesive pieces/material to fix them in place on the play surface.

A device as disclosed herein may include, for example, a first rotor arranged and configured to rotate around a primary axis of the device in a first rotational direction, the first rotor comprising a tip on which the device balances when in operation; a first chassis rotatably connected to the first rotor; a counter-rotor arranged and configured to exert a counter-rotation in a second rotational direction, rotationally opposite the first direction, when the counter-rotor is powered; and a controller arranged and configured to control the first rotor and the counter-rotor, based on a signal received by the controller, to control a rotational speed of the device, a horizontal movement of the device, or a combination thereof.

The device may include a horizontal motion control configured to cause the device to move horizontally in response to a signal from the controller, by changing the location of the center of mass of the device. The horizontal motion control may include a mass attached to an actuator, where the actuator is configured to change the position of the mass in response to a signal from the controller. The mass may include or be formed from at least a portion of the first chassis, such as the first chassis and one or more components disposed within the first chassis. The mass may include a battery configured to provide power to one or more components within the device and/or one or more other functional components of the device, i.e., one or more other components that are present in the device not only for the additional mass but also to provide structural, control, communications, or other functionality within the device. The mass may be movable in two or more horizontal directions.

The counter-rotor may include a centrifugal fan having a plurality of blades disposed essentially perpendicular to the first rotational direction and configured to rotate around the primary axis to impart rotational torque on the first chassis. The counter-rotor may include a plurality of fans disposed around the primary axis and configured to impart rotational torque on the first chassis. As another example, the counter-rotor may include a weighted disk having a mass non-uniformly and non-symmetrically arranged around the primary axis to impart rotational torque on the first chassis.

The rotor of the device may include a cylindrical wall that extends around the first chassis.

At least a portion of the first rotor, such as the tip, may be replaceable. In some embodiments the entire rotor assembly may be replaceable.

The device may include an inertial measurement unit configured to detect movement and/or orientation of the device or a component of the device. The IMU may be configured to, for example, obtain a measurement of a rate of rotation of the first chassis and to provide a control signal to the controller based on the measurement. The IMU may detect other forms of motion of the device and provide appropriate signal(s) of such to the controller, which may operate other components of the device in response to such signal(s). The controller may be configured to use data from the IMU in a feedback loop to maintain an orientation, rotational speed, or horizontal motion of the device. For example, the controller may be configured to maintain a straight-line horizontal motion of the device based on data from the IMU and a control signal indicating a user input of desired movement direction. As another example, the controller may be configured to detect a fall or impact of the device based on a signal from the IMU and to alert the user based on the fall or impact. Similarly, the controller may be configured to disable at least one motor in the device upon based on the fall or impact, such as to prevent damage to the device or components of the device. As another example, the controller may be configured to detect an impact caused by another device, and/or to detect an impact of the device against another device, based on a signal received from the IMU. The controller may be configured to degrade performance of at least one component of the device based on a detection of an impact caused by another device. The controller also may be configured to detect a shaking motion of the device based on a signal received from the IMU, and to change a state of the device based on the shaking motion. The controller may be configured to detect the device being lifted off a surface by a user based on a signal from the IMU.

The device may include an outer housing that contains at least the chassis and the controller. The outer housing may be replaceable separately from other components of the device.

The device may include a disk arranged around a rotational axis of the device, which may have a non-circular outer circumference.

The rotor may include a weighted circumference region having a different type, density, or thickness of material relative to other portions of the rotor.

Embodiments disclosed herein also provide a controllable top as previously disclosed, configured to operate in conjunction with a remote controller configured to enable remote operation of device. The remote controller may include, for example, a substantially horizontal wheel that controls rotation of controllable top, and a trigger that controls the direction of movement of the top.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

While the figures may show or suggest a particular order of operations performed by certain implementations, such order is illustrative and not limiting. Other implementations and various embodiments may perform the operations in a different order, combine certain operations, perform certain operations in parallel, overlap performance of certain operations such that they are partially in parallel, and the like.

The above description includes several example implementations. However, it will be understood by one of skill in the art that the invention disclosed herein is not limited to the implementations described and can be practiced with modification and alteration within the spirit and scope of the appended claims. The description is thus illustrative instead of limiting.

What is claimed is:

1. A device comprising:

a controllable top comprising:

a first rotor arranged and configured to rotate around a primary axis of the device in a first rotational direction, the first rotor comprising a tip on which the device balances when in operation;

a first chassis rotatably connected to the first rotor;

a counter-rotor arranged and configured to exert a counter-rotation in a second rotational direction, rotationally opposite the first direction, when the counter-rotor is powered;

a controller arranged and configured to control the first rotor and the counter-rotor, based on a signal received by the controller, to control a rotational speed of the device, a horizontal movement of the device, or a combination thereof; and a horizontal motion control configured to cause the device to move horizontally in response to a signal from the controller, by changing the location of the center of mass of the device;

wherein said counter-rotor comprises at least one of:

(a) a centrifugal fan having a plurality of blades disposed essentially perpendicular to the first rotational direction and configured to rotate around the primary axis to impart rotational torque on the first chassis;

(b) a weighted disk having a mass non-uniformly and non-symmetrically arranged around the primary axis to impart rotational torque on the first chassis.

2. The device of claim 1, wherein the horizontal motion control comprises a mass attached to an actuator; and wherein the actuator is configured to change the position of the mass in response to a signal from the controller.

3. The device of claim 2, wherein the mass comprises a battery configured to provide power to one or more components within the device.

4. The device of claim 2, wherein the mass is movable in two or more horizontal directions.

5. The device of claim 1, wherein the tip of the rotor is replaceable.

6. The device of claim 1, further comprising an inertial measurement unit (IMU) configured to determine a movement and/or orientation of the device or a component of the device.

7. The device of claim 6, wherein the controller is configured to detect a fall or impact of the device based on a signal from the IMU and to alert the user based on the fall or impact.

8. The device of claim 6, wherein the controller is configured to detect a fall or impact of the device based on a signal from the IMU and to disable at least one motor in the device based upon the fall or impact.

9. The device of claim 6, wherein the controller is configured to detect an impact caused by another device, and/or to detect an impact of the device against another device, based on a signal received from the IMU.

10. The device of claim 9, wherein the controller is further configured to degrade performance of at least one component of the device based on a detection of an impact caused by another device.

11. The device of claim 6, wherein the controller is configured to detect the device being lifted off a surface by a user based on a signal from the IMU.

12. The device of claim 6, wherein the IMU is configured to obtain a measurement of a rate of rotation of the first chassis and to provide a control signal to the controller based on the measurement.

13. The device of claim 1, wherein the controller is configured to maintain a straight-line horizontal motion of the device based on data from the IMU and a control signal indicating a user input of desired movement direction.

14. The device of claim 1, further comprising a disk arranged around a rotational axis of the device, the disk having a non-circular outer circumference.

15. The device of claim 1, wherein the first rotor further comprises a weighted circumference region comprising a different type, density, or thickness of material relative to other portions of the first rotor.

16. A system comprising:

a controllable top comprising:

a first rotor arranged and configured to rotate around a primary axis of the device in a first rotational direction, the first rotor comprising a tip on which the device balances when in operation;

a first chassis rotatably connected to the first rotor;

a counter-rotor arranged and configured to exert a counter-rotation in a second rotational direction, rotationally opposite the first direction, when the counter-rotor is powered;

a controller arranged and configured to control the first rotor and the counter-rotor, based on a signal received by the controller, to control a rotational speed of the device, a horizontal movement of the device, or a combination thereof; and a horizontal motion control configured to cause the device to move horizontally in response to a signal from the controller, by changing the location of the center of mass of the device;

wherein said counter-rotor comprises at least one of:

(a) a centrifugal fan having a plurality of blades disposed essentially perpendicular to the first rotational direction and configured to rotate around the primary axis to impart rotational torque on the first chassis;

(b) a weighted disk having a mass non-uniformly and non-symmetrically arranged around the primary axis to impart rotational torque on the first chassis; and a remote control device configured to enable remote operation of the controllable top;

wherein the remote control device comprises:

a substantially horizontal wheel that controls rotation of the controllable top; and a trigger that controls a direction of movement of the controllable top.

17. The system of claim 16, wherein the controller is arranged and configured to change an orientation of the controllable top based upon movement of the substantially horizontal wheel.

18. The system of claim 16, the controllable top further comprising a horizontal motion control configured to cause the device to move horizontally in response to a signal from the remote control, by changing the location of the center of mass of the device.

* * * * *